US009445694B2

(12) United States Patent
Ophardt

(10) Patent No.: US 9,445,694 B2
(45) Date of Patent: Sep. 20, 2016

(54) DISPENSER COVER

(71) Applicant: OP-Hygiene IP GmbH, Niederbipp (CH)

(72) Inventor: Heiner Ophardt, Arisdorf (CH)

(73) Assignee: OP-Hygiene IP GmbH, Niederbipp (CH)

( * ) Notice: Subject to any disclaimer, the term of this patent is extended or adjusted under 35 U.S.C. 154(b) by 93 days.

(21) Appl. No.: 14/463,939

(22) Filed: Aug. 20, 2014

(65) Prior Publication Data

US 2016/0051095 A1 Feb. 25, 2016

(51) Int. Cl.

| | |
|---|---|
| ***A47K 5/12*** | (2006.01) |
| ***A47K 10/38*** | (2006.01) |
| ***A47K 10/42*** | (2006.01) |
| *A47K 10/32* | (2006.01) |

(52) U.S. Cl.

CPC ..... *A47K 5/12* (2013.01); *A47K 5/1207* (2013.01); *A47K 10/38* (2013.01); *A47K 10/426* (2013.01); *A47K 2010/3233* (2013.01)

(58) Field of Classification Search

CPC .... A47K 5/12; A47K 10/426; A47K 5/1207; A47K 10/38; A47K 2010/3233

USPC ..... 222/173, 181.3, 180, 181.1, 181.2; 221/45

See application file for complete search history.

(56) References Cited

U.S. PATENT DOCUMENTS

| | | | | |
|---|---|---|---|---|
| 3,886,698 | A | 6/1975 | Raith et al. | |
| 4,068,120 | A | 1/1978 | Throckmorton et al. | |
| 5,226,625 | A | 7/1993 | Hanna | |
| 5,431,309 | A | 7/1995 | Ophardt | |
| 7,044,329 | B2 * | 5/2006 | Lum | A47F 9/042 206/554 |
| 7,232,045 | B2 | 6/2007 | Ophardt et al. | |
| D568,659 | S | 5/2008 | Ophardt et al. | |
| D628,421 | S | 12/2010 | Ophardt et al. | |
| 8,256,644 | B2 * | 9/2012 | Orgna | A47K 5/1202 221/45 |
| 8,479,957 | B2 | 7/2013 | Ophardt | |
| 2008/0099497 | A1 * | 5/2008 | Reinsel | A47K 10/425 221/45 |
| 2008/0257906 | A1 | 10/2008 | Orgna | |
| 2012/0173017 | A1 * | 7/2012 | Balkin | A47K 17/003 700/232 |
| 2014/0014675 | A1 | 1/2014 | Ingvarsson et al. | |

* cited by examiner

*Primary Examiner* — Donnell Long

(74) *Attorney, Agent, or Firm* — Thorpe North & Western, LLP

(57) ABSTRACT

A cover preferably for a dispenser comprised of at least two components which are assembled together with a joint seam between edge portions of the components and an extrudable material extruded to provide a continuous elongate bead which overlies the joint seal, hiding the joint seal from view and presenting a visible bead surface spanning between exterior surfaces of the components.

21 Claims, 23 Drawing Sheets

DISPENSER COVER

SCOPE OF THE INVENTION

This invention relates to covers for dispensers and, more particularly, to an improved cover and method of making the same.

BACKGROUND OF THE INVENTION

Various covers are known which serve the purpose of a shroud-like member which enclose a cavity as by being mounted to a housing. For example, in the context of a dispenser of hand cleaning fluid or of disposable hand towels, a cover is typically secured to a housing for the dispenser with the cover enclosing the consumable product in a cavity defined between the cover and the housing and with the cover movable between a closed position for normal use in dispensing of the product and an open position in which the housing may be accessed for replenishing of the consumable product. Typical such housing may be enclosed on a top, a front and two sides.

Such covers are known and may be formed as by injection moulded from plastic or may comprise two or more plastic parts which are secured together. Such known constructions suffer the disadvantage that either relatively expensive moulds are required to produce a cover. The cover may also be formed from sheet metal with two or more parts typically welded together.

Known metal constructions have the disadvantage that welding operations are typically required and that the metal parts to be secured together by welding cannot readily be pre-finished as with a final coating.

SUMMARY OF THE INVENTION

To at least partially overcome these disadvantages of previously known devices, the present invention provides a cover preferably for a dispenser comprised of at least two components which are assembled together with a joint seam between edge portions of the components and an extrudable material extruded to provide a continuous elongate bead which overlies the joint seal, hiding the joint seal from view and presenting a visible bead surface spanning between exterior surfaces of the components.

In one aspect, the present invention provides a cover defining a cavity therein:

the cover including a central panel and a side panel, the central panel having an exterior surface, an edge and an edge portion bordering along the edge of the central panel, the side panel having an exterior surface, an edge and an edge portion bordering along the edge of the left side panel, the central panel mechanically coupled to the side panel along by a mechanical coupling of the edge portion of the central panel to the edge portion of the left side panel forming an elongate joint seam therebetween along which the exterior surface of the central panel is discontinuous with the exterior surface of the left side panel, an elongate bead of hardened extruded material extending longitudinally of the joint seam and overly the joint seam, the bead having a surface extending circumferentially thereabout normal a longitudinal of the bead, the surface consisting of a hidden-from-view interior surface and an outwardly directed visible exterior surface with the interior surface and the exterior surface merging circumferentially into each other, the bead interior surface bonded to both the edge portion of the central panel and the edge portion of the side panel to secure the edge portion of the central panel to the edge portion of the left side panel, the bead interior surface spanning the joint seam, the bead interior surface adhesively bonded to the edge portion of the central panel proximate the joint seam on a first side of the joint seam and adhesively bonded to the edge portion of the side panel proximate the joint seam on a second side of the joint seam, the bead exterior surface spanning between the exterior surface of central panel on the first side of the joint seam and the exterior surface of the side panel on the second side of the joint seam and hiding the elongate joint seam along its length from visual view outwardly from the cover.

In another aspect, the present invention provides a dispenser of a consumable product selected from the group of hand cleaning fluid and hand towels, the dispenser comprising:

a housing and a cover mounted to the housing for movement between an open and a closed position, a cavity defined between the housing and the cover when the cover is in the closed containing the consumable product, the dispenser activatable to dispense the consumable product with the cover in the closed position, when the cover is in the open position, access is provided to the cavity to replenish the consumable product, the cover including a central panel, a left side panel and a right side panel, wherein:

the central panel having an exterior surface, a left edge and a left edge portion bordering along the left edge of the central panel, the left side panel having an exterior surface, an edge and an edge portion bordering along the edge of the left side panel, the central panel mechanically coupled to the left side panel along a left by a mechanical coupling of the left edge portion of the central panel to the edge portion of the left side panel forming an elongate left joint seam therebetween along which the exterior surface of the central panel is discontinuous with the exterior surface of the left side panel, an elongate left bead of hardened extruded material extending longitudinally of the left joint seam and overly the left joint seam, the left bead having a surface extending circumferentially thereabout normal a longitudinal of the left bead, the surface consisting of a hidden-from-view interior surface and an outwardly directed visible exterior surface with the interior surface and the exterior surface merging circumferentially into each other, the left bead interior surface bonded to both the left edge portion of the central panel and the left edge portion of the left side panel to secure the left edge portion of the central panel to the left edge portion of the left side panel, the left bead interior surface spanning the left joint seam, the left bead interior surface adhesively bonded to the left edge portion of the central panel proximate the left joint seam on a first side of the left joint seam and adhesively bonded to the edge portion of the left side panel proximate the left joint seam on a second side of the left joint seam, the left bead exterior surface spanning between the exterior surface of central panel on the first side of the left joint seam and the exterior surface of the left side panel on the second side of the left joint seam and hiding the elongate left joint seam along its length from visual view outwardly from the cover, the central panel having an exterior surface, a right edge and a right edge portion bordering along the right edge of the central panel, the right side panel having an exterior surface, an edge and an edge portion bordering along the edge of the right side panel, the central panel mechanically coupled to the right side panel along a right by a mechanical coupling of the right edge portion of the central panel to the edge portion of the right side panel forming an elongate right joint seam therebetween along which the exterior surface of the central panel is discontinuous with the exterior surface of the right side panel, an elongate right bead of hardened extruded material extending longitudinally of the right joint seam and overly the right joint seam, the right bead having a surface extending circumferentially thereabout normal a longitudinal of the right bead, the surface consisting of a hidden-from-view interior surface and an outwardly directed visible exterior surface with the interior surface and the exterior surface merging circumferentially into each other, the right bead interior surface bonded to both the right edge portion of the central panel and the right edge portion of the right side panel to secure the right edge portion of the central panel to the right edge portion of the right side panel, the right bead interior surface spanning the right joint seam, the right bead interior surface adhesively bonded to the right edge portion of the central panel proximate the right joint seam on a first side of the right joint seam and adhesively bonded to the edge portion of the right side panel proximate the right joint seam on a second side of the right joint seam, the right bead exterior surface spanning between the exterior surface of central panel on the first side of the right joint seam and the exterior surface of the right side panel on the second side of the right joint seam and hiding the elongate right joint seam along its length from visual view outwardly from the cover.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
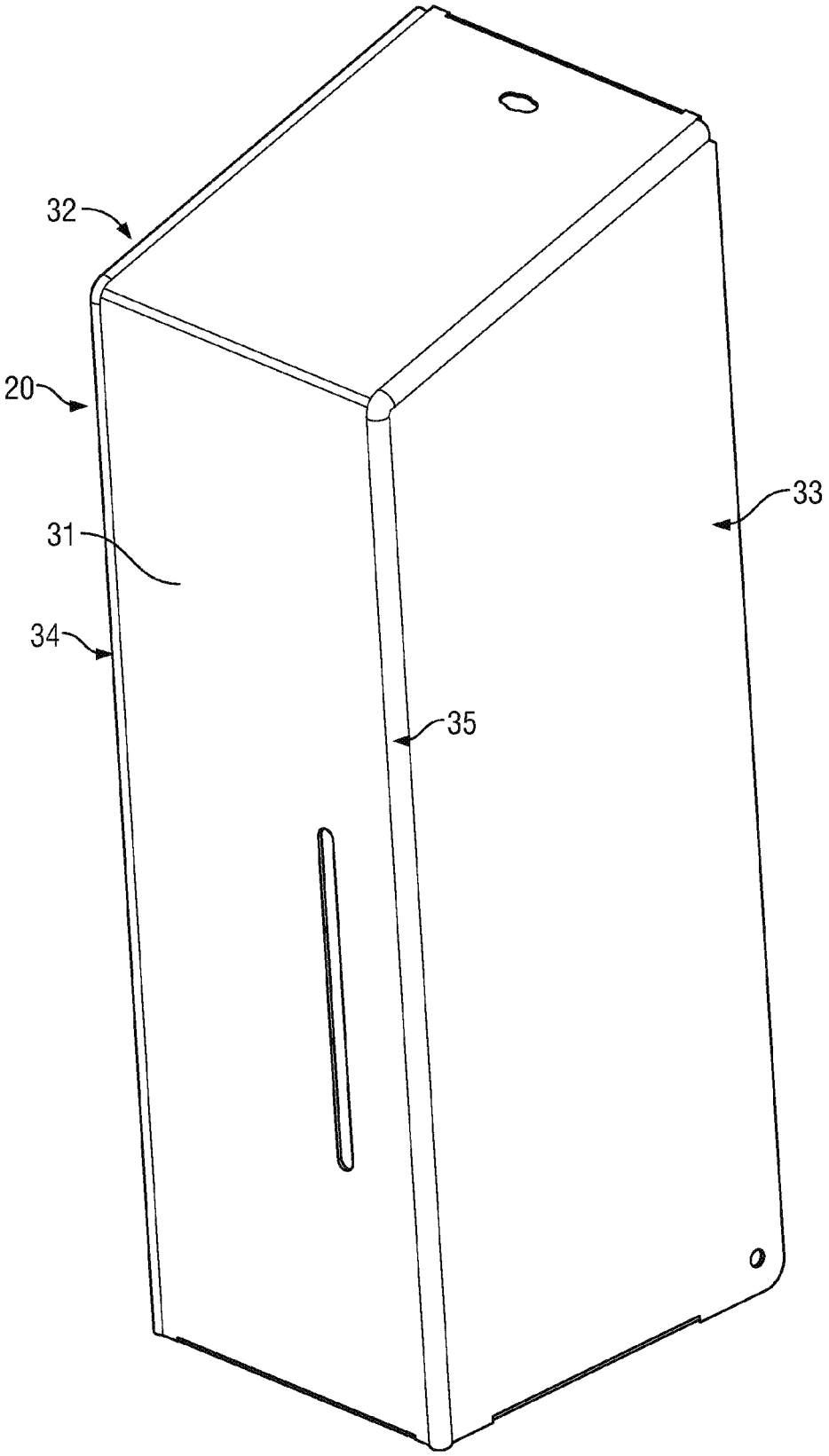
FIG. 1 illustrates a front pictorial view of a cover in accordance with a first embodiment of the present invention for a hand cleaning soap dispenser or a toilet paper dispenser.
Figure 2:
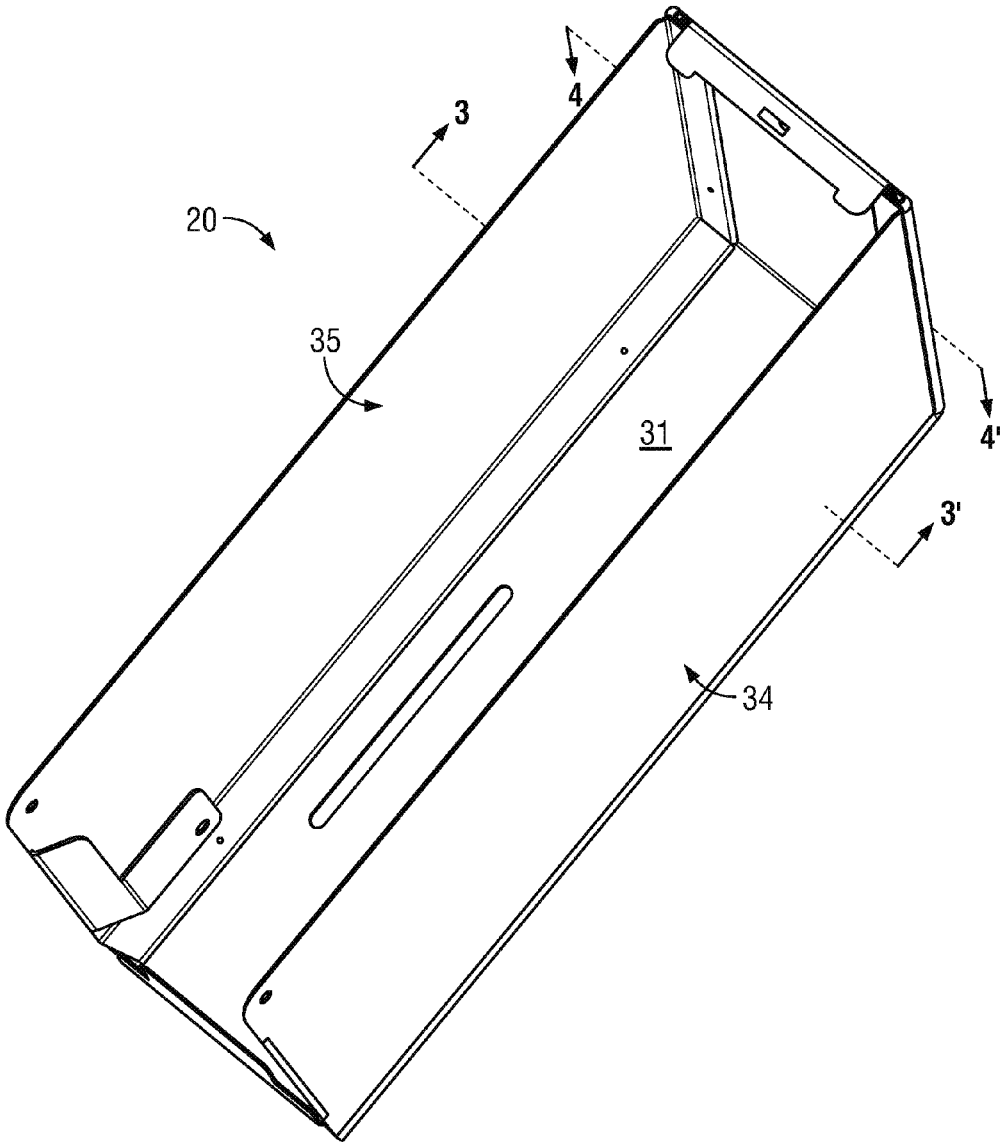
FIG. 2 is a rear pictorial view of the cover shown in FIG. 1.

Reference is made to FIGS. 1 to 10 which illustrate a cover 20 in accordance with a first embodiment of the present invention. The cover 20 includes a central panel 31, a left side panel 32 and a right side panel 33. As can be seen in each of FIGS. 1 to 4 and FIG. 10, along a left corner seam between the central panel 31 and the left side panel 32, a left bead 34 is provided and along a right corner seam between the central panel 31 and the right side panel, a right bead 35 is provided.

Figure 5:
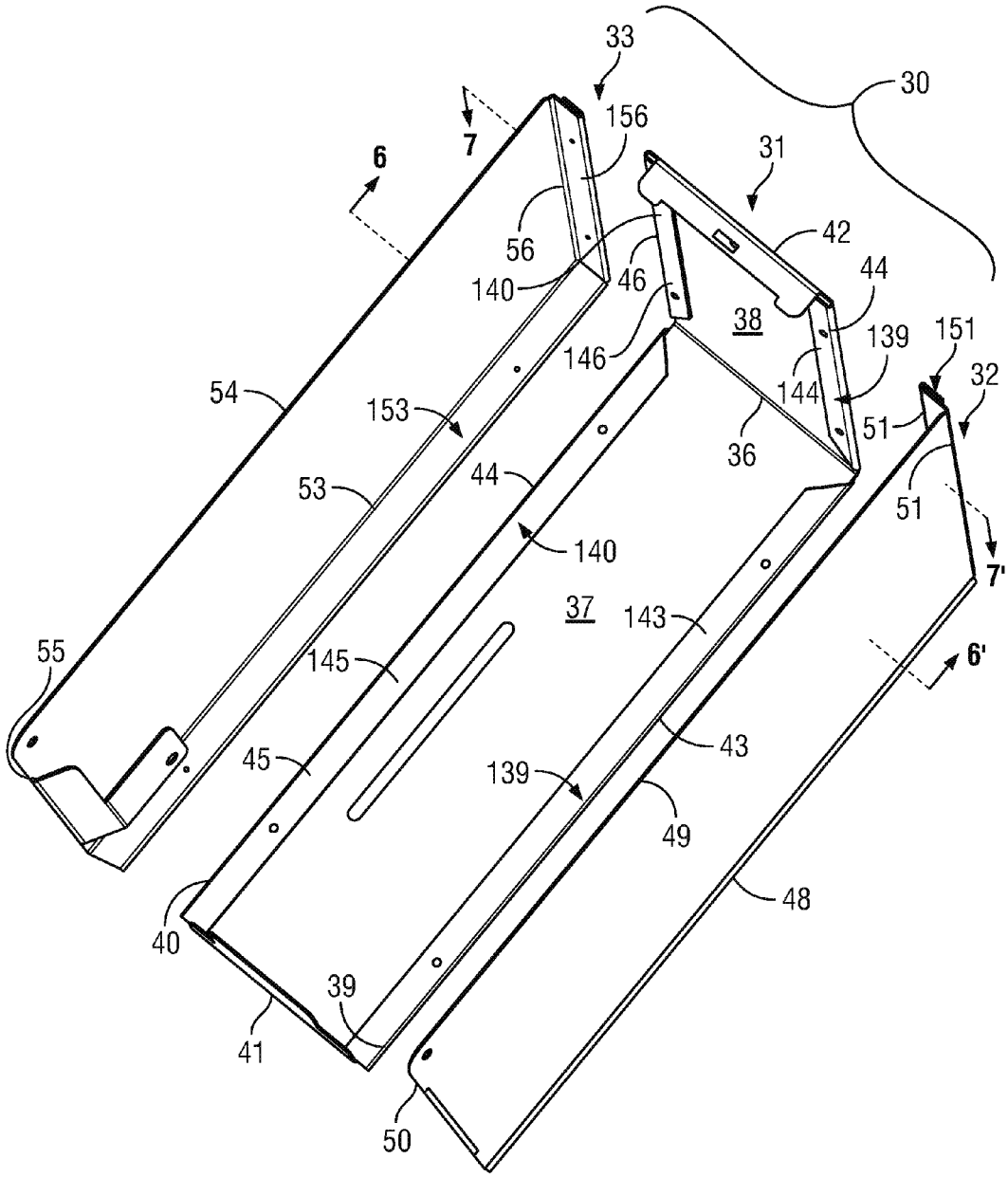
FIG. 5 is a rear pictorial exploded view of the cover of FIG. 1.
Figure 6:
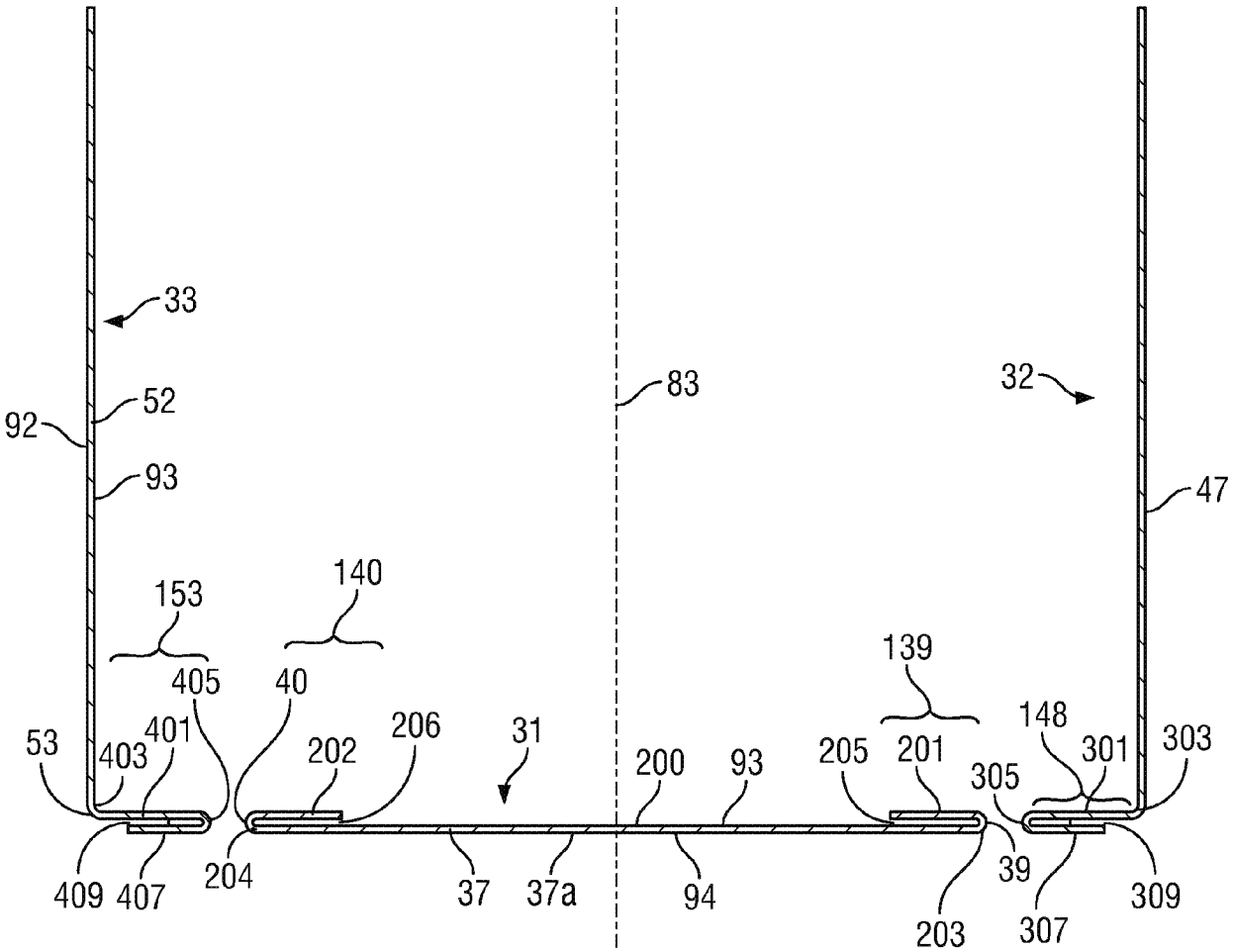
FIG. 6 is a cross-sectional view through the exploded cover of FIG. 5 along section line 6-6' in FIG. 5.
Figure 7:
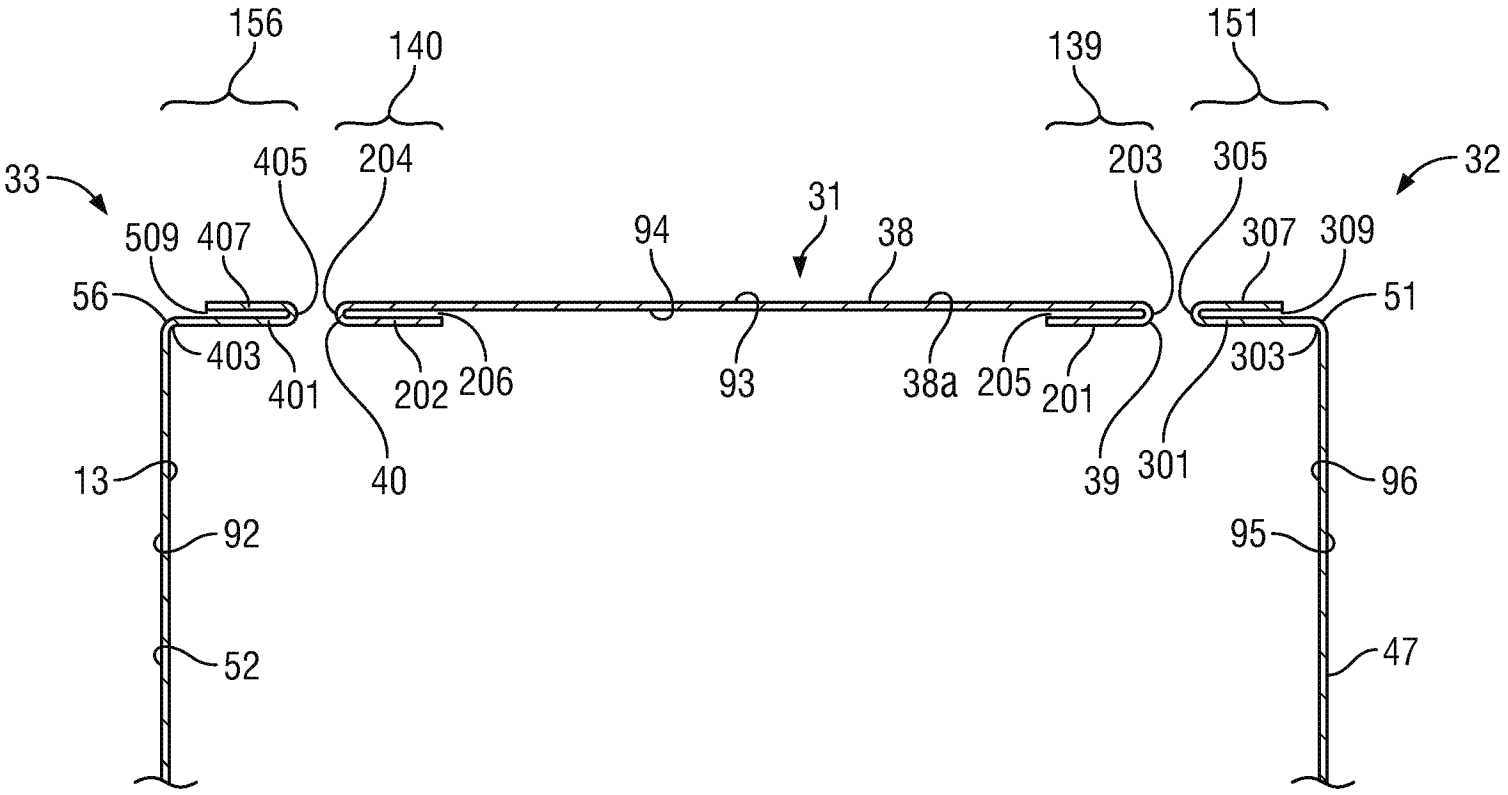
FIG. 7 is a partial cross-sectional view through the exploded cover of FIG. 5 along section line 7-7' in FIG. 5.

Reference is made to FIGS. 5 to 7 which show the central panel 31, left side panel 32 and right side panel 33 in exploded views of the cover. The central panel 31 is formed from a unitary first sheet member, preferably of metal, bent about a fold line 36 so that the central panel 31 has a front panel 37 with a forwardly directed front surface 37*a* which merges upwardly at the fold line 36 into a top panel 38 having an upwardly directed top surface 38*a*.

The central panel 31 has peripheral edges thereabout. The central panel has a central panel left edge 39, a central panel right edge 40, a central panel bottom edge 41 and a central panel top edge 42. The central panel left edge 39 extends between the central panel bottom edge 41 and the central panel top edge 42 on the left side of the central panel 31. The central panel right edge 40 extends between the central panel bottom edge 41 and the central panel top edge 42 on a right side of the central panel 31.

Adjacent the central panel left edge 39, a left edge portion 139 borders along the central panel left edge 39. The left edge portion 139 forms an open hem with the left edge portion 139 comprising a peripheral flange 201 bent about a blight 203 to return back over a rear surface 200 of the central panel defining a locating slot 205 therebetween open laterally inwardly away from the central panel left edge 39 and closed at a laterally outward end by the bight 203.

Similarly adjacent the central panel right edge 40, a right edge portion 140 borders along the central panel right edge 40. The right edge portion 140 forms an open hem comprising a peripheral flange 202 bent about a blight 204 to return back over the rear surface 200 of the central panel defining a locating slot 206 therebetween open laterally inwardly away from the central panel right edge 40 and closed at a laterally outward end by the bight 204.

The central panel left edge 39 has a central panel left edge lower section 43 laterally of the front panel 37 and a central panel left edge top section 44 laterally of the top panel 38. The left edge portion 139 is provided in two sections, namely, a lower section 143 bordering on the central panel left edge lower section 43 and a top section 144 bordering on the central panel left edge top section 44. The central panel right edge 40 has a central panel right edge lower section 45 laterally of the front panel 37 and a central panel right edge top section 46 laterally of the top panel 38. The right edge portion 140 is provided in two sections, namely, a lower section 145 bordering on the central panel right edge lower section 45 and a top section bordering on 146 bordering on the central panel right edge top section 46.

The left side panel 32 is also formed from a unitary sheet member, preferably of metal. The left side panel 32 has a laterally outwardly directed left side surface 47. The left side panel 32 is bordered by peripheral edges. The left side panel 32 has a left side panel front edge 48, a left side panel rear edge 49, a left side panel bottom edge 50 and a left side panel top edge 51. The left side panel front edge 48 extends between the left side panel bottom edge 50 and the left side panel top edge 51 at the front of the left side panel 32. The left side panel rear edge 49 extends between the left side panel bottom edge 50 and the left side panel top edge 51 at the rear of the left side panel 32.

Adjacent the left side panel front edge 48, a left edge portion 148 borders along the left side panel front edge 48. The left edge portion 148 is an open hem comprising a peripheral first flange 301 bent about a first blight 303 to extend laterally inwardly away from left side surface 47, preferably approximately normal to the left side surface 47 to a second bight 305 which directs the left side edge portion 148 laterally outwardly as a second peripheral return flange 307 which returns back over an outer exterior surface 95 of the left side panel 32 defining a located slot 309 between the return flange 307 and the first flange 301 open laterally outwardly toward the left side panel front edge 48 and closed at a laterally inward end by the second bight 305.

Similarly adjacent the left side panel top edge 51, a left edge portion 151 borders along the left side panel top edge 51. The top edge portion 151 is an open hem comprising a peripheral first flange 301 bent about a first blight 303 to extend laterally inwardly away from left side surface 47, preferably approximately normal to the left side surface 47 to a second bight 305 which directs the left side edge portion 148 laterally outwardly as a second peripheral return flange 307 which returns back over the outer exterior surface 95 of the left side panel 32 defining a located slot 309 between the return flange 307 and the first flange 301 open laterally outwardly away from the left side panel front edge 48 and closed at a laterally inward end by the second bight 305.

The right side panel 33 is also formed from a unitary sheet member, preferably of metal, and has a laterally outwardly directed right side surface 52. The right side panel 33 has a right side panel front edge 53, a right side panel rear edge 54, a right side panel bottom edge 55 and a right side panel top edge 56. The right side panel front edge 53 extends between the right side panel bottom edge 55 and the right side panel top edge 56 on the front of the right side panel 33. The right side panel rear edge 54 extends between the right side panel bottom edge 55 and the right side panel top edge 56 on the rear of the right side panel 33.

Adjacent the right side panel front edge 53, a right edge portion 153 borders along the right side panel front edge 53. The right edge portion 153 is an open hem comprising a peripheral first flange 401 bent about a first blight 403 to extend laterally inwardly away from the right side surface 52, preferably approximately normal to the right side surface 52 to a second bight 405 which directs the right side edge portion 153 laterally outwardly as a second peripheral return flange 409 which returns back over an outer exterior surface 92 of the right side panel 33 defining a located slot 405 between the return flange 407 and the first flange 401 open laterally outwardly toward the right side panel front edge 53 and closed at a laterally inward end by the second bight 405.

Similarly adjacent the right side panel top edge 56, a right edge portion 156 borders along the right side panel top edge 56. The top edge portion 156 is an open hem comprising a peripheral first flange 401 bent about a first blight 403 to extend laterally inwardly away from the right side surface 52, preferably approximately normal to the right side surface 52 to a second bight 405 which directs the right side edge portion 156 laterally outwardly as a second peripheral return flange 407 which returns back over the outer exterior surface 92 of the right side panel 33 defining a located slot 405 between the return flange 407 and the first flange 401 open laterally outwardly toward the right side panel front edge 53 and closed at a laterally inward end by the second bight 405.

Reference is made to FIGS. 8 to 11 showing the assembly of the central panel 31, left side panel 32 and the right side panel 33 to form the cover 30.

Figure 4:
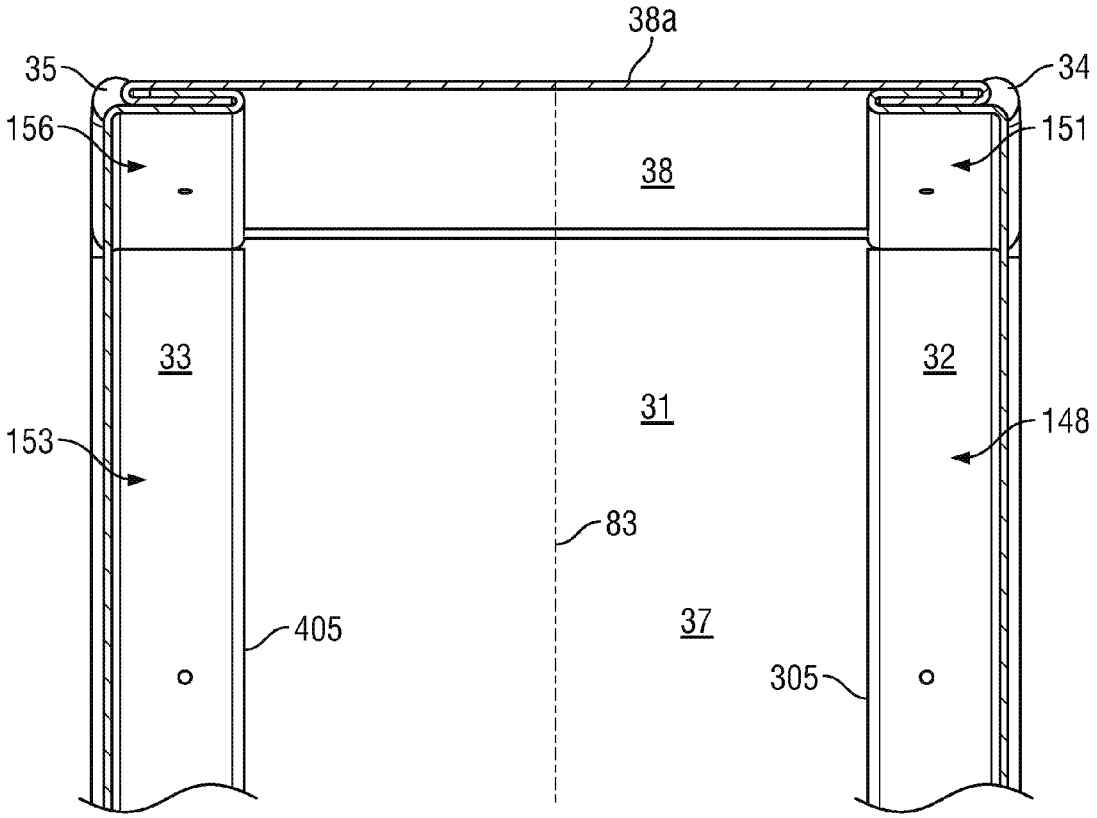
FIG. 4 is a partial cross-sectional view through the cover along section line 4-4' in FIG. 2.
Figure 8:
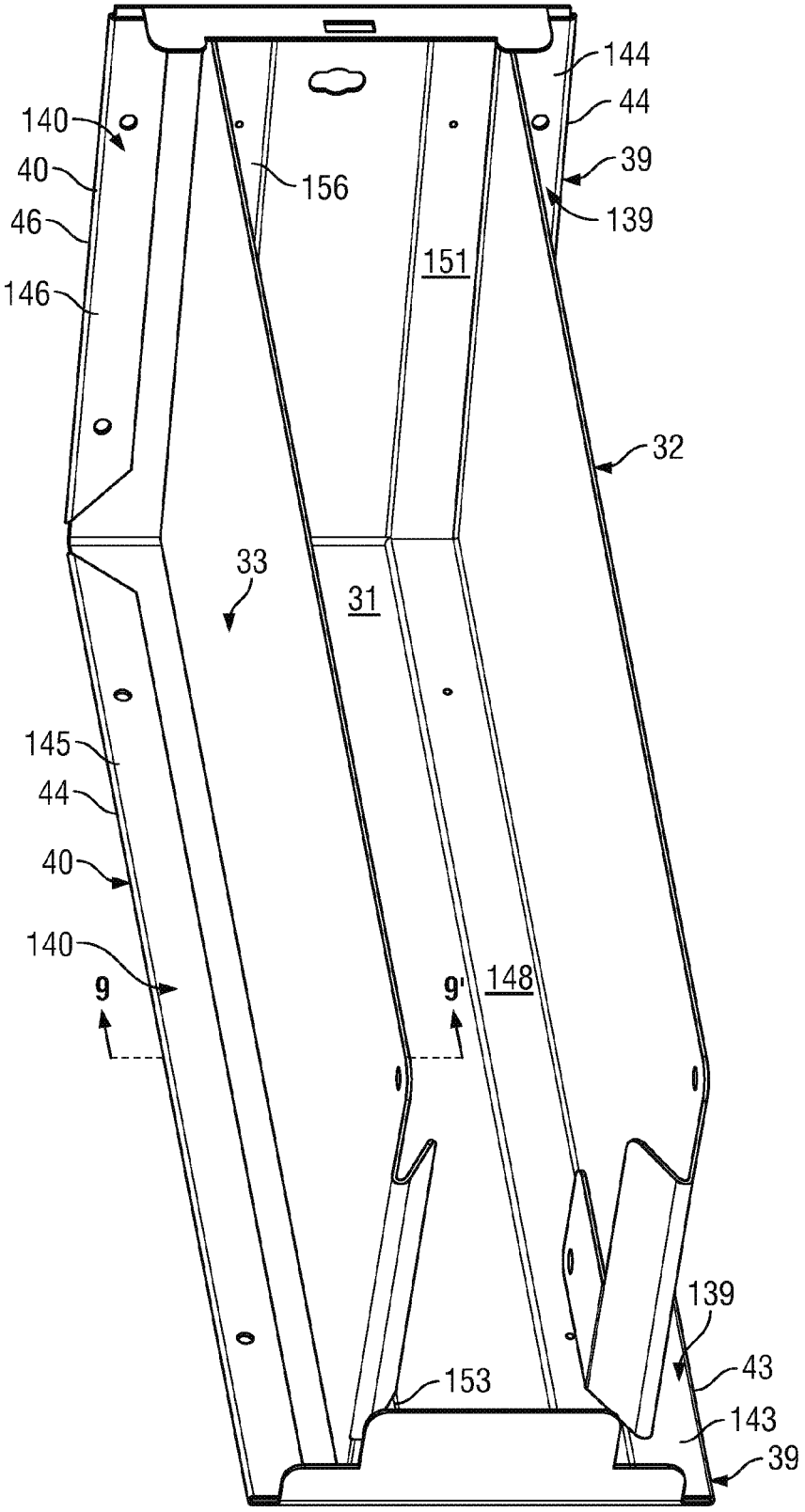
FIG. 8 is a rear pictorial exploded view of the cover of FIG. 1 similar to that shown in FIG. 5 but as seen from the left side and showing the components in relative exploded pre-assembly positions ready for assembly.

In a pre-assembly exploded position as seen in FIG. 8, the left side panel 32 is located relative to the central panel 31 with the open hems of the left edge portion 148 and the left edge portion 151 of the left side panel 32 laterally inwardly of the open hems of the lower section 143 and the top section 144, respectively, of the left edge portion 139 of the central panel 31. From the orientation as shown in FIG. 8, the left side panel 32 is moved laterally to the right relative the central panel 31 so as to assume the assembled condition as shown in FIGS. 4 and 5 with the open hems mating to form a hemmed joint seam, however, with the left bead 34 having yet been applied. Similarly, the right side panel 33 is located as shown in FIG. 8 relative to the central panel 31 with the open hems of the right edge portion 153 and the right edge portion 156 of the right side panel 33 laterally inwardly of the open hems of the lower section 145 and the top section 146, respectively, of the right edge portion 140 of the central panel 31. From the orientation as shown in FIG. 8, the right side panel 33 is moved laterally relative the central panel 31 on as to assume the assembled condition as shown in FIGS. 4 and 5 with the open hems mating to form a hemmed joint seam, however, with the right bead 35 having yet been applied.

Figure 9:
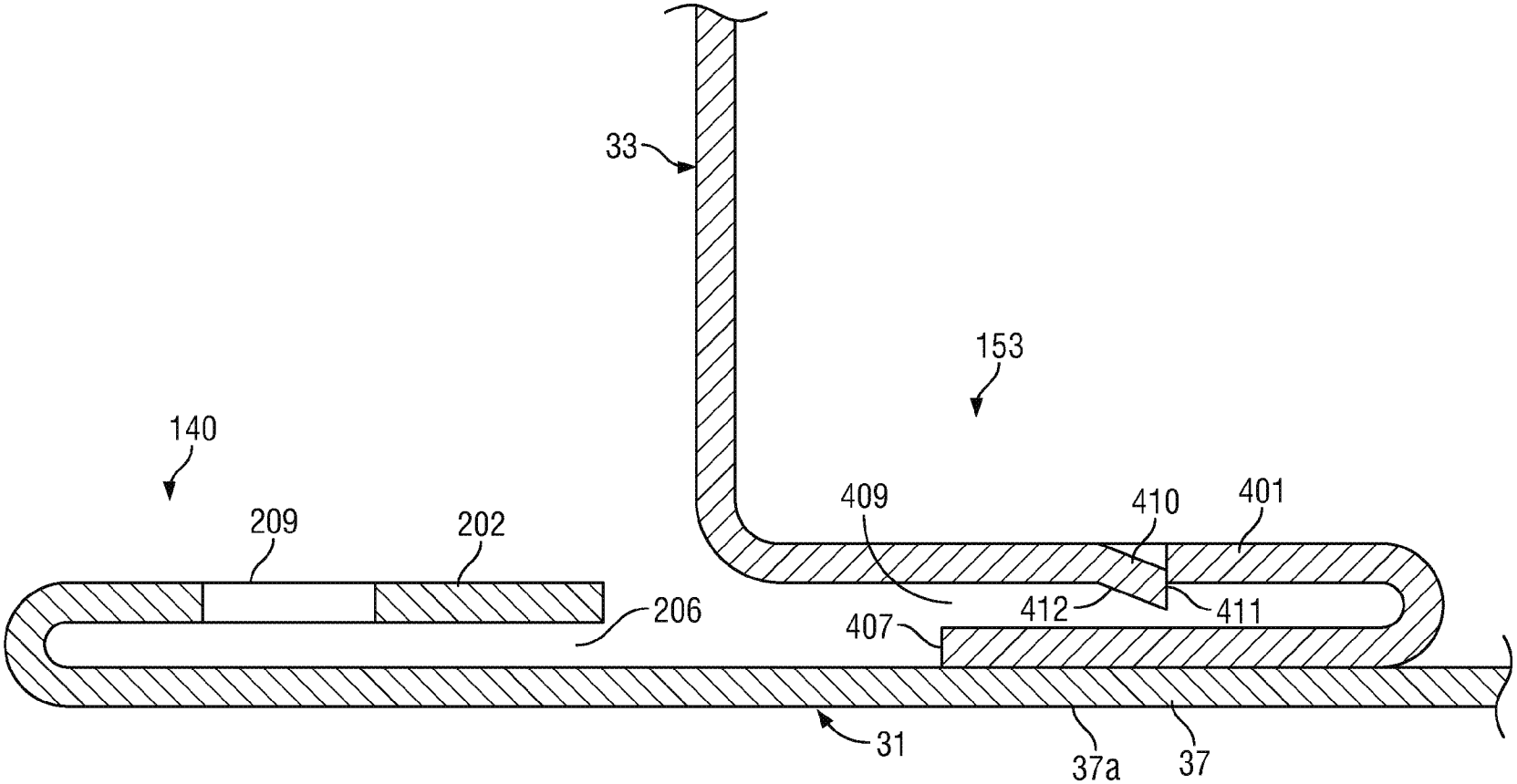
FIG. 9 an enlarged partial horizontal cross-sectional view along section line 9-9' in FIG. 8 showing the relative locations of a central panel and a right side panel as in FIG. 8.
Figure 10:
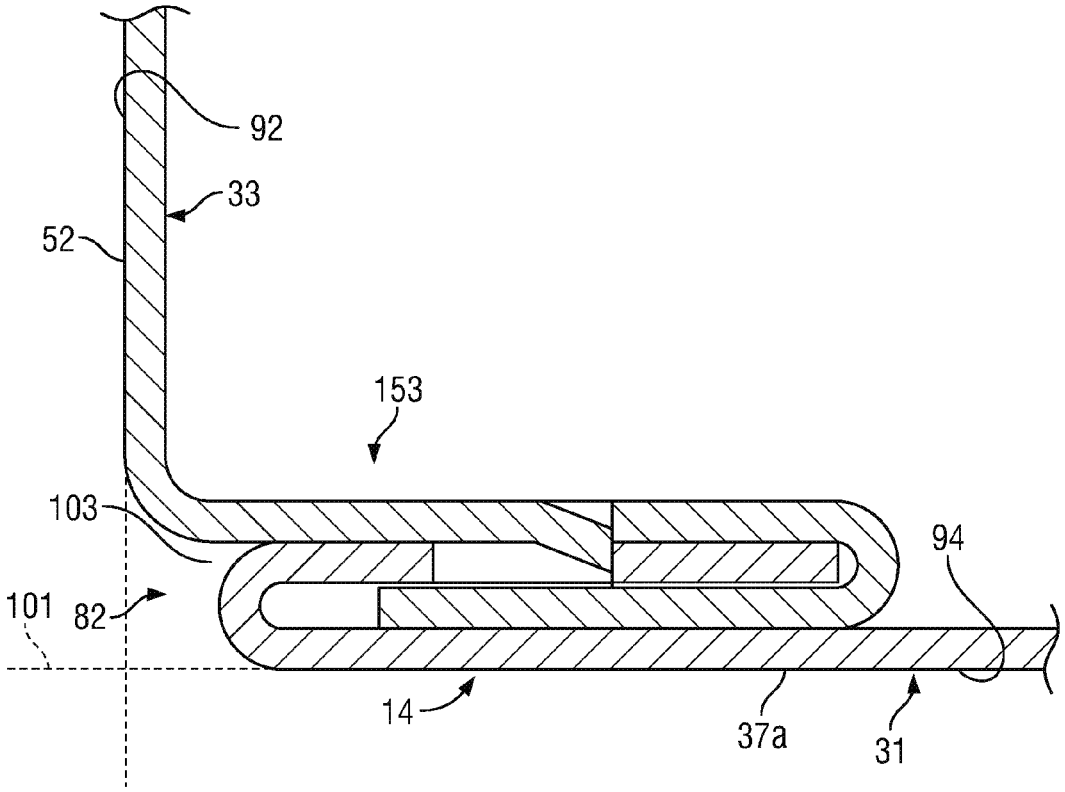
FIG. 10 is a view the same as FIG. 9 showing the relative locations of the central panel and the right side panel in a mechanically coupled engagement from which they have been moved relative to the position in FIG. 9.

The relative lateral movement of the side panel 33 relative the central panel 31 to form the hemmed joint seam is particularly shown in sequence in FIGS. 9 and 10. FIG. 9 is a cross-section through section line 9-9' in FIG. 8 showing the relative position of the open hem of the right edge portion 153 of the right side panel 33 laterally inwardly of the open hem of the lower section 145 of the right edge portion 140 of the central panel 31. From the position of FIG. 8, with relative lateral sliding of the right side panel 33 towards the right, as seen in FIG. 9, the return flange 407 of the right edge portion 153 of the right side panel 33 slides into the slot 206 of the right edge portion 140 of the central panel 31, and the return flange 202 of the right edge portion 140 of the central panel 31 slides into the slot 409 of the right edge portion 153 of the right side panel 33.

While not necessary, as seen in FIGS. 8 and 9, the interacting open hems have a latching and locating arrangement to further assist in providing a mechanical coupling of the open hems together. The return flange 202 of the right edge portion 140 of the central panel 31 has a locating opening 209 therethrough. The flange 401 of the left edge portion 153 of the right side panel 33 has a resilient locating finger 410 which is bent forwardly from the first flange 401 and extends laterally inwardly and forwardly to a distal end 411 to become disposed within the slot 209. As the return flange 202 of the right edge portion 140 of the central panel 31 slides into the slot 409 of the right edge portion 153 of the right side panel 33, the return flange 202 engages an angled cam surface 412 of the locating finger 410, deflecting the locating finger 410 rearwardly, until the distal end 411 reaches the locating opening 209 whereupon under the inherent bias of the locating finger 410, the distal end 411 becomes located within the locating opening 209 of the return flange 202. The engagement between the distal end 411 of the locating finger 410 and the locating opening 209 serves to prevent relative sliding of the right side panel 33 laterally inwardly relative the central panel 31 and, as well, can be utilized to relatively locate the right side panel 33 in a desired position laterally relative the central panel 31 by moving the right side panel 33 laterally outwardly past a position that the distal end 411 is engaged within the locating opening 209, then moving the right side panel 33 laterally inwardly until the distal end 411 engages the inward edge of the locating opening 209.

FIG. 10 shows the right side panel 33 with the distal end 411 of the locating finger 410 engaging the inward edge of the locating opening 209. As can be seen in FIG. 10, a right joint seam 82 is provided and which, in the assembled condition of FIG. 10, is visible from the exterior of the cover at the right corner of the cover. The sheet member comprising the central panel 31 has the exterior surface 91 and an interior surface 93. Similarly, the sheet member forming the right side panel 33 has the exterior surface 92 and an interior surface 94 and the sheet member forming the left side panel 32 has the exterior surface 95 and an interior surface 96. As seen in FIG. 10, the front panel 37 of the central panel 31 has a forwardly directed front surface **37*a* which is a portion of the exterior surface 91 disposed in a flat plane. The right side panel 33 provides a portion of the exterior surface 91 as the laterally outwardly directed side surface 52, shown in FIG. 10, to be in a flat plane. On FIG. 10, a dashed line 101 represents an extension of the front surface 37*a* and a dashed line 102 represents an extension of the right side surface 52. The right joint seam 82 may be considered as those portions of the exterior surface 91 of the right side panel 33 and the central panel 31 inwardly from the dashed lines 101 and 102 with the joint 82 including a longitudinally extending channelway 103 along the length of the joint 82**.

Figure 11:
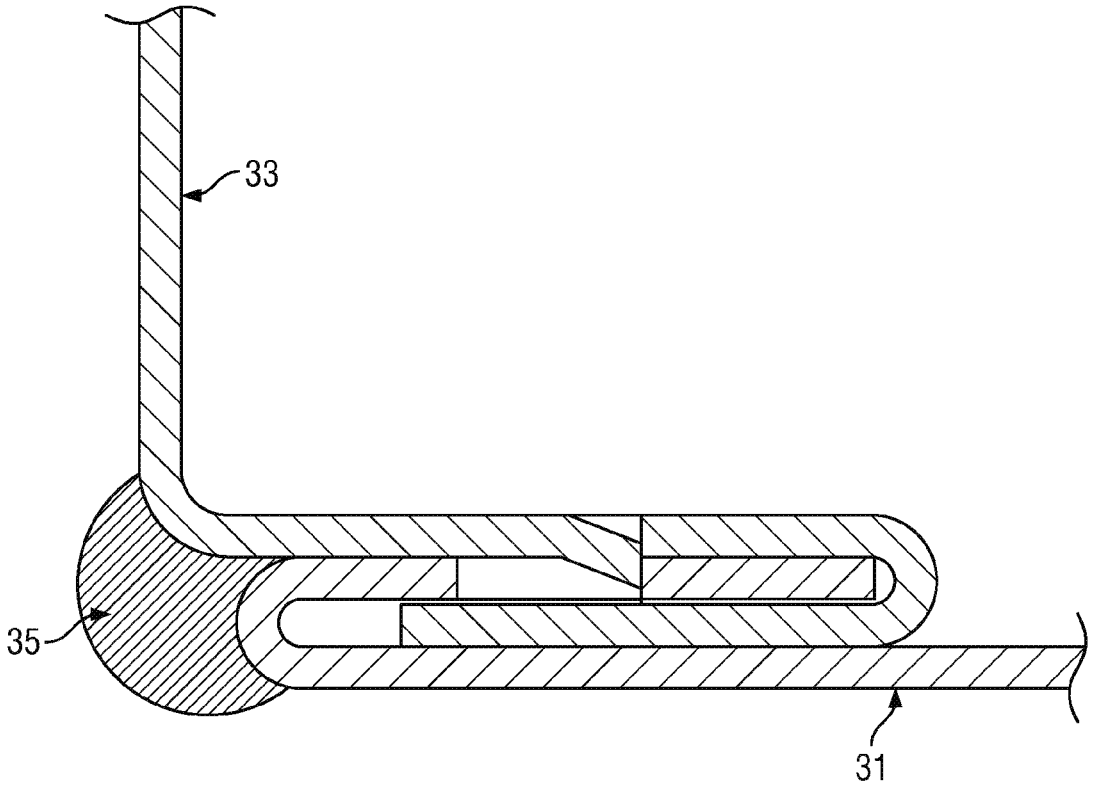
FIG. 11 is a view the same as FIG. 10, however, showing a bead applied to bond the central panel and the right side panel in mechanically coupled engagement.

Reference is made to FIG. 11 which illustrates the cover 20 after a final step of manufacture in which the right bead 35 has been applied by extruding an extruded material in a flowable state longitudinally along the right joint seam 82 to have a cross-sectional profile as seen in FIG. 11, and then hardening the extruded material in place as shown in FIG. 11. The right bead 35 extends longitudinally of the joint seam 82 as along a longitudinal 104 of the right bead 35. In any plane normal the longitudinal 104 such as in the plane shown in FIG. 11, the right bead 35 has a circumferential extent with a circumferential surface comprising an exterior surface 105 visible from the exterior of the cover and an interior surface 106 which bonds to surfaces of the central panel 31 and the right side panel 33 engaged by the interior surfaces 106. Thus, the right bead 35 has a circumferential surface extending circumferentially thereabout normal longitudinal 104 of the right bead 35 with this circumferential surface consisting of a hidden from view interior surface 106 and an outwardly directed visible exterior surface 105 with the interior surface 106 and the exterior surface 105 merging circumferentially into each other.

The right bead interior surface 106 is bonded to both the right edge portion 140 of the central panel 31 and the right edge portion 153 of the right side panel 33 to secure the right edge portion 140 of the central panel 31 to the right edge portion 153 of the right side panel 33. The right bead interior surface 106 spans the right joint seam 82 with the right bead interior surface 106 adhesively bonded to the right edge portion 140 of the central panel 31 proximate the right joint seam 82 on a first side of the right joint seam 82 and adhesively bonded to the edge portion 153 of the right side panel 33 proximate the right joint seam 82 on a second side of the right joint seam 82.

The right bead exterior surface 105 spans between the exterior surface 93 of the central panel 31 on the first side of the right joint seam 82 and the exterior surface 92 of the right side panel 33 on the second side of the right joint seam 82 and hides the elongate right joint seam 82 along its length from visual view outwardly from the cover.

In the preferred embodiment as shown in FIG. 11, the right bead 35 extends outwardly beyond the dashed lines 101 and 102 in FIG. 10 and spans between the forwardly directed front surface **37*a* of the central panel 31 and the outwardly directed right side surface 52 of the right side panel 33 providing a pleasing corner detail on the cover and one which effectively renders visible merely the exterior surface 105 of the right bead 35, the forwardly directed front surface 37*a* of the central panel 31 and the outwardly directed right side surface 52 of the right side panel 33. With the interior surface of the right bead 35 bonded to the edge portion 153 of the right side panel 33 and the edge portion 140 of the central panel 31, the right bead 35 serves to secure the central panel 31 and the left side panel 32 together against relative movement. In this regard, the adhesive bonding of the right bead 35 of the right side panel 33 to the central panel 31 together with the mechanical interaction of the edge portion 153 of the right side panel 33 and the edge portion 140 of the central panel 31 provides together an enhanced mechanical coupling without the need for either the right bead 35 or the mechanical coupling to, by themselves, be sufficient to overcome any moment forces to be applied to the cover 20**.

The right bead 35 is preferably extruded onto the cover 20 by an automated extrusion machine which is capable of providing a resultant bead with a preferred predetermined cross-sectional shape and size. Preferably, the right bead 35 has in any cross-section normal to its longitudinal, its exterior surface 105 to be of constant cross-sectional shape, however, this is not necessary and the cross-sectional shape of the exterior surface 105 of the left bead may be varied in a desired manner longitudinally. Preferably, the automated extrusion apparatus will simultaneously extrude both the right bead 35 and the left bead 34 with the central panel 31, right side panel 33 and left side panel 32 in an assembled condition.

Figure 3:
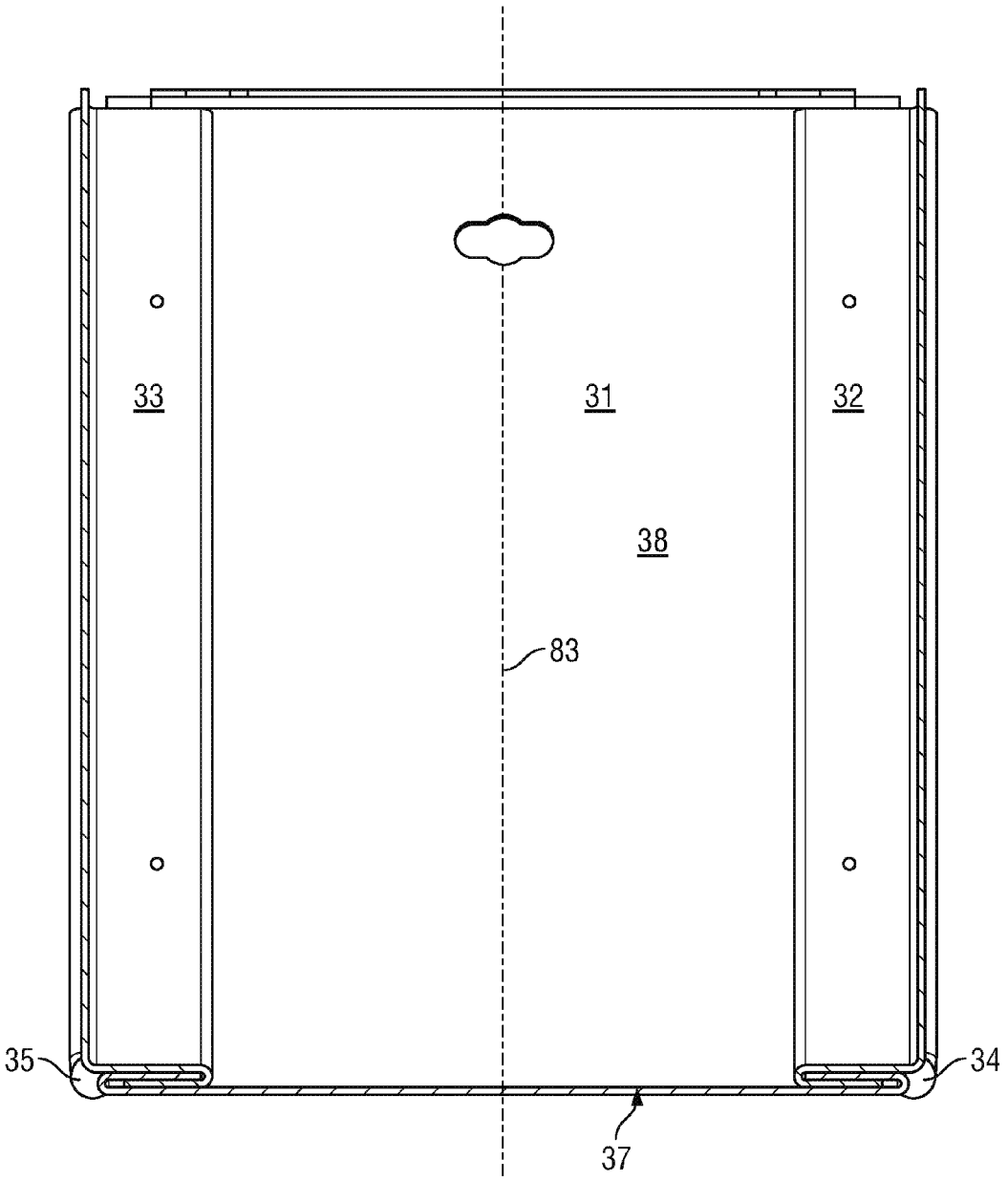
FIG. 3 is a cross-sectional view through the cover along section line 3-3' in FIG. 2.

When assembled, the cover 20 is symmetrical about a central vertically extending plane indicated as 83 in each of FIGS. 3 and 4. The central panel 31 is symmetrical about the central plane 83 and thus the central panel right edge portion 140 is a mirror image of the central panel left edge potion 139.

The left side panel 32 is a mirror image of the right side panel 33 about the central plane 82.

With the upper portion 61 and the lower portion 62 of locating member 60 on the right side of the central panel 31 so engaging the located members 74 and 75, respectively, on the right side panel 33, a right channelway 82 is defined along their spaced adjacent edges. The right channelway 82 includes a right channelway lower portion 83, as seen in FIG. 5, between the first 64 and the first leg 77 and a right channelway upper portion 84, as seen in FIG. 4, between the first leg 69 and the first leg 80. With the central panel 31 and the right side panel 33 maintained in an assembled condition forming the right channelway 82 therebetween, the right bead 35 is extruded into the right channelway 82 to fill the right channelway 82 and bond the right side panel 33 and the central panel 31 together across the right channelway 82. The right bead 35 presents an outwardly directed visible bead surface 85 along the right channelway 82.

Each of the right bead 35 and the left bead 34 is formed from a material which can be extruded in a flowable state to overlie the right seam 82 preferably into the right channelway 103 and, after extrusion, hardens in place. The extrudable material for the right bead 35 is preferably a synthetic polymer or plastic material has a pleasing exterior surface when hardened. Preferably, the material will have adhesive properties which will bond to the surfaces of the central panel 31 and the right side panel 33 that it engages to hold them together against removal.

In an analogous manner to that described regarding coupling of the right side panel 33 to the central panel 31, the left side panel 32 is similarly coupled to the central panel 31. As can be seen in FIG. 1, the resultant cover 20 is provided with a pleasing external appearance with each of the left bead 34 and the right bead 35 being visible between adjacent the corners of the central panel 31 and respective left side panel 32 and the right side panel 33.

As seen in FIGS. 1, 4 and 5, in the preferred first embodiment, the left bead 34 and the right bead 35 are each provided to have a cross-sectional profile which includes a corner 90 between a flat surface 92 in the plane of the exterior flat surfaces 37 and 38 of the central panel 31 and a flat surface 93 in the plane of the side surfaces 53 and 54 of the respective side panels 32 and 33. This is but one preferred configuration for the surface of the beads 34 and 35 and is by no means limited. The beads may be rounded or of other shapes including longitudinally extending grooves therein. The beads may be disposed above or below the surfaces of the adjacent portions of the central panel 31 or each of the side panels 32 and 33. Each of the beads 34 and 35 may be concave rounded outwardly or convex rounded inwardly as in the manner of a depression or groove.

Figure 12:
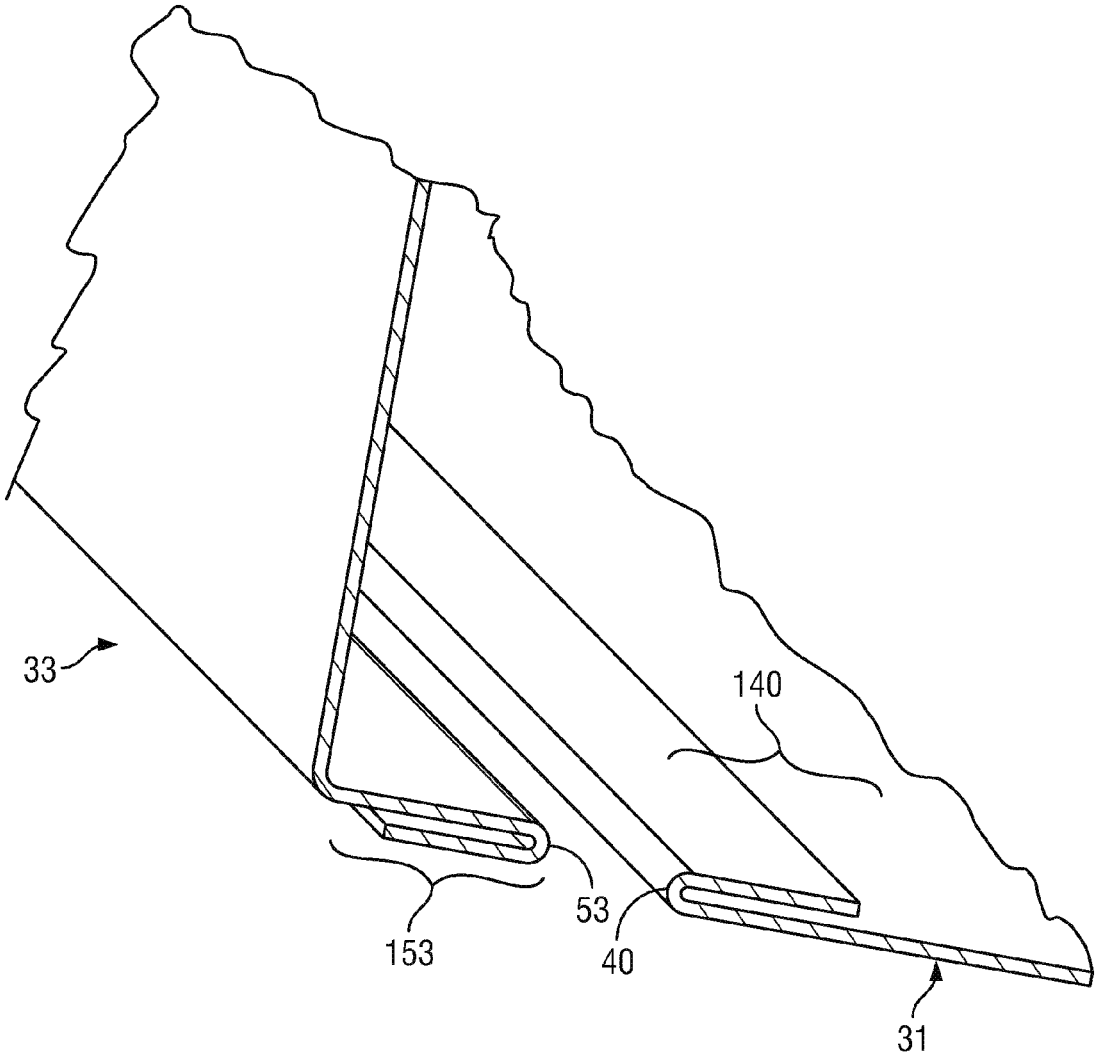
FIG. 12 is a schematic partially cut-away pictorial view of the cross-section right side panel and the central panel as would be seen in perspective view at the bottom left hand corner of FIG. 6.

FIG. 12 is a schematic pictorial view of the first embodiment of the invention showing the right side panel 33 and the central panel 31 as would be seen in partial cross-section at the bottom left hand side of FIG. 6 showing the right side panel 33 and the central panel 31 in an exploded pre-assembly position and showing the opposed hems adapted to be mated to form the hemmed right joint seam.

Reference is made to FIGS. 13 to 17 which show a second embodiment of the present invention in which the right side panel 33 and central panel 31 have edge portions adapted to form a slot and tab joint seam.

Figure 13:
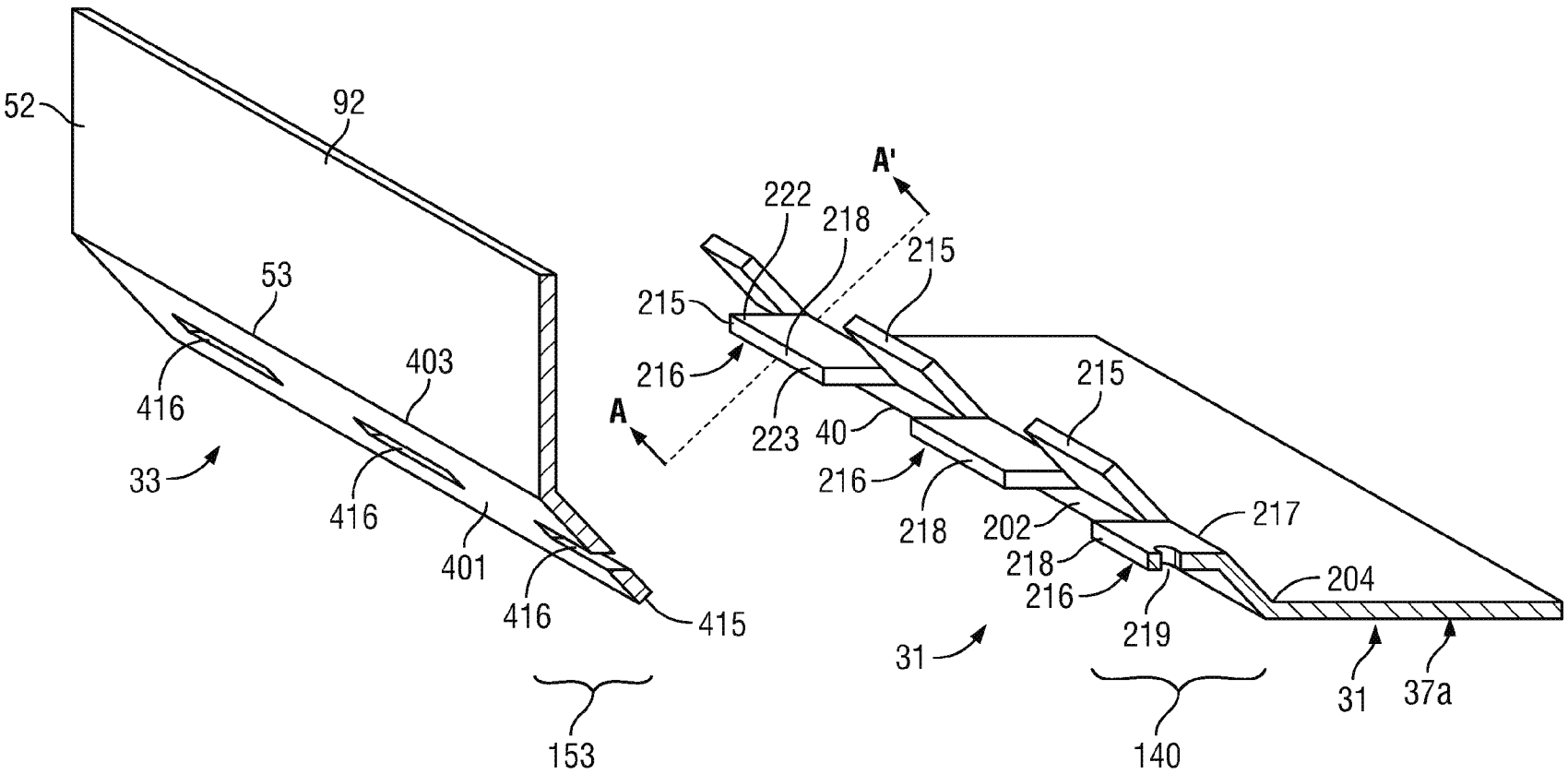
FIG. 13 is a schematic pictorial view the same as FIG. 12 but showing a central panel and a right side panel prior to assembly in accordance with a second embodiment of the present invention adapted to form a slot and tab joint seam.

FIG. 13 is a schematic pictorial view substantially identical to FIG. 12, however, showing a modified form of the right edge portion 140 of the control panel 31 and a complementary modified arrangement of the right edge portion 153 of the right side panel 33 as adapted to be secured together and form a slot and tab joint seam.

Figure 14:
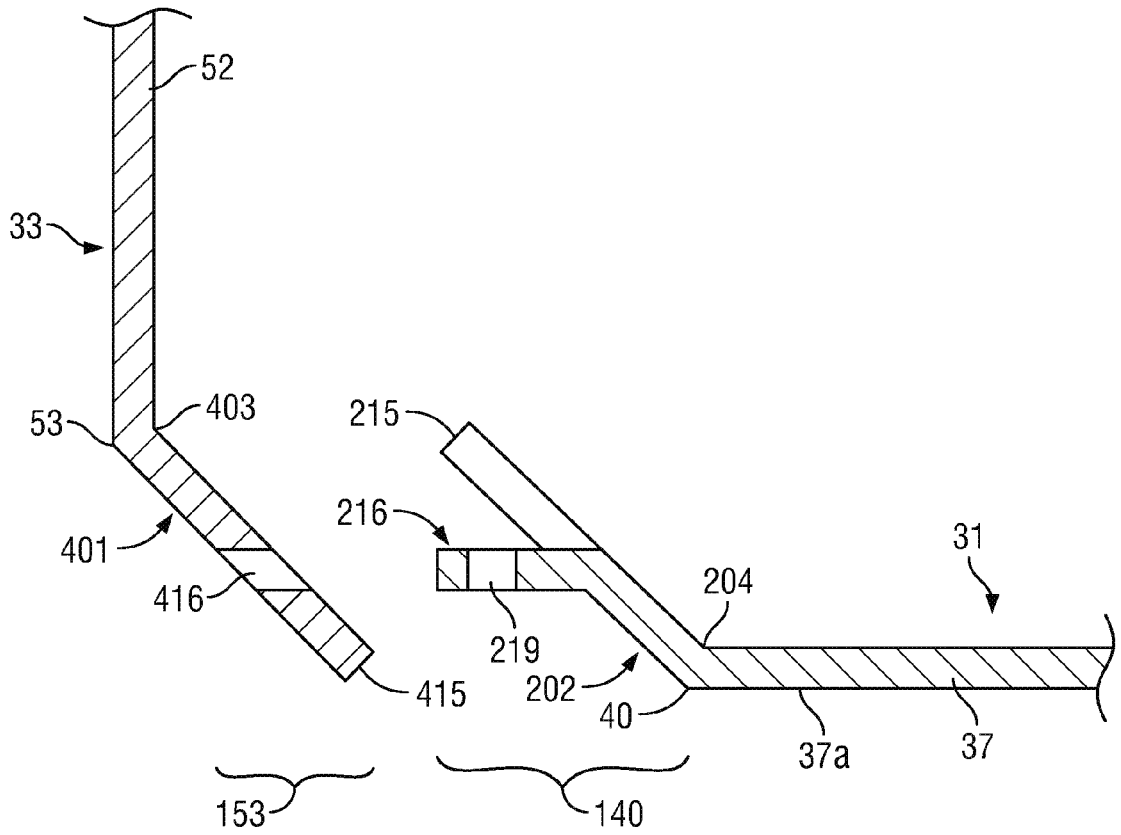
FIG. 14 is a cross-sectional view of the central panel and right side panel shown in FIG. 13 in the pre-assembly position of FIG. 13.

FIG. 14 is a cross-section view of the cross-section ends of the right side panel 33 and the central panel 31 as seen in FIG. 13 in a pre-assembly condition. In assembly, the right side panel 33 and the central panel 31 are moved towards each other from the position of FIG. 14 to the position of FIG. 15 illustrating a mechanically coupled orientation of the central panel 31 and the right side panel 33.

Figure 15:
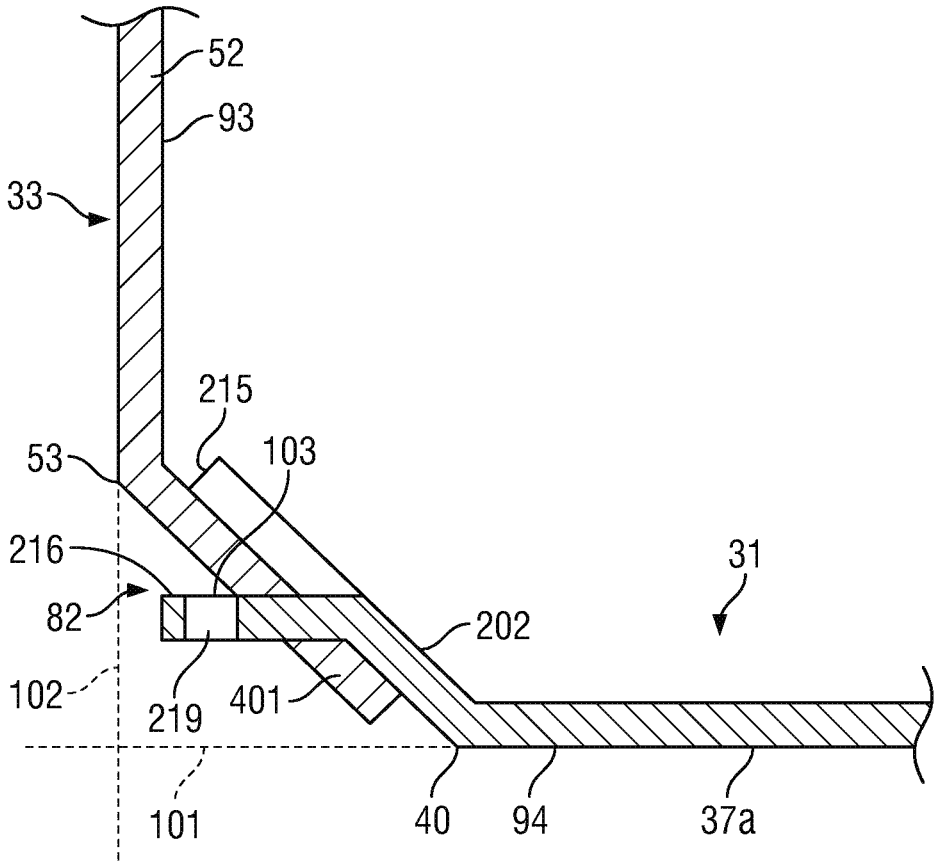
FIG. 15 is a view the same as FIG. 14 showing the relative locations of the central panel and the right side panel in a mechanically coupled orientation from which they have been moved relative to the position of FIG. 14.
Figure 16:
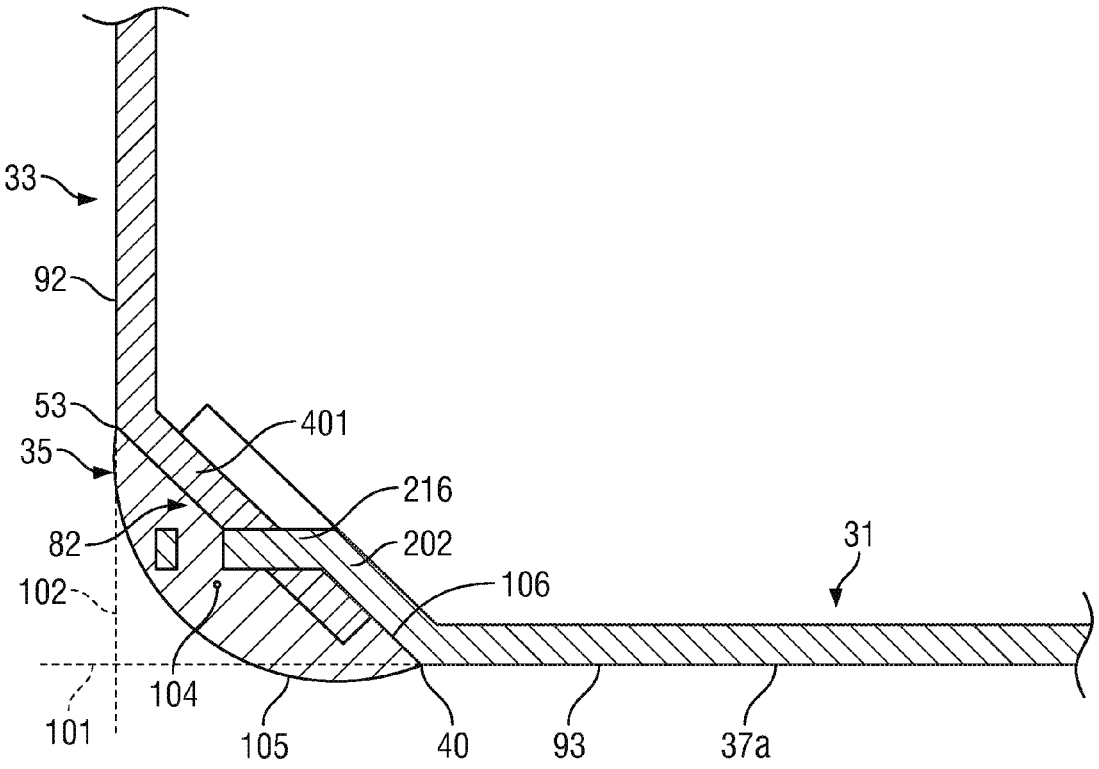
FIG. 16 is a view the same as FIG. 15, however, showing a right bead as applied to bond the central panel and the right side panel in the mechanically coupled orientation.

FIG. 16 illustrates a condition in which with the right side panel 33 and the central panel 31 in the mechanically coupled orientation of FIG. 15, the right side bead 35 is applied to overlie the right side joint seam 82 longitudinally along the joint seam 82. In the second embodiment of FIGS. 14 to 18, similar elements to those in the first embodiment of FIGS. 1 to 13 are referred to with the same reference numerals.

Referring to FIG. 13, the right side panel 33 is formed from a unitary sheet member preferably of metal and has a laterally outwardly directed right side surface 52. The right side panel 33 has a right side panel front edge 53. Adjacent the right side panel front edge 53, a right edge portion 153 borders along the right side panel front edge 53. The right side panel 153 comprises a peripheral first flange 401 bent along a first bight 403 to extend laterally inwardly away from the right side surface 52, preferably, approximately 45 degrees to the right side surface 52 to a distal end 415. A series of slots 416 are provided transversely through the first flange 401 at spaced locations longitudinally along the right edge portion 153.

As seen in FIG. 13, the central panel 31 has a central panel right edge 40 with a right edge portion 140 bordering along the central panel right edge 40. The right edge portion 140 comprises a peripheral flange 202 bent about a bight 204 to extend inwardly from the front panel 35 and preferably be disposed at an angle of about 45 degrees relative to the forwardly directed front surface 37*a*. The flange 202 ends at a distal end 215.

A series of tabs 216 are provided in the flange 202 bent relative the flange 202 to extend out of the plane of the flange 202, preferably to extend parallel to the surface 37 laterally away from the bight 204. As can be seen, each of the tabs 216 are bent about a bight 217 and extend from the bight 217 to a distal tab end 218. Each of the tabs is spaced longitudinally along the flange 202 spaced from each other and having a relative longitudinal extent complementary to the spacings of the slots 416 on the right side panel 33. Each of the tabs 216 is adapted to slide through a respective one of the slots 416 to mechanically couple the right side panel 33 and the central panel 31 together as seen in FIG. 15. From the pre-assembled positions of the right side panel 33 and the central panel 31 in FIGS. 13 and 14, relative sliding of the right side panel 33 and the central panel 31 from the position of FIG. 14 results in the tabs 216 passing through their corresponding slots 416 to assume the mechanically coupled orientation shown in FIG. 15. As seen in FIG. 15, preferably, the flange 202 on the central panel 31 is provided to be disposed at an angle complementary to the flange 401 on the right side panel 33 and, thus, the exterior surface 94 of the flange 202 preferably engages with the interior surface 93 of the flange 401. In the mechanically coupled orientation as seen in FIG. 15, one tab 216 is shown to pass through one of the slots 413. As seen in FIG. 15, the tab 216 shown has a tab hole 219 extending therethrough. On FIG. 15, a dashed line 101 represents an extension of the front surface 37*a* and a dashed line 102 represents an extension of the right side surface 52. A right joint seam 82 may be considered as those portions of the right side panel 33 and the central panel 31 inwardly from the dashed lines 101 and 102 where the seam 82 may be considered to include a channelway 103 between the tab 216 and the flange 401.

Reference is made to FIG. 16 which illustrates the arrangement of FIG. 15 after a final step of manufacture has been carried out in which the right bead 35 has been applied by extruding along the right joint seam 82 to have a cross-sectional profile as seen in FIG. 16, and then hardening the extruded material in place as shown in FIG. 16. The right bead 35 extends longitudinally of the joint seam 82 as along the longitudinal 104 of the right bead 35. Preferably, in any plane normal the longitudinal, such as in the plane shown in FIG. 16, the right bead 35 has a circumferential extent with circumferential surface comprising an exterior surface 105 visible from the exterior of the cover and an interior surface 106 which bonds to surfaces of the central panel 31 and the right side panel 33 engaged by the interior surface 106. The right bead 35 is shown to have been extruded so as to extend through the tab hole 219 to provide for securing of the right side panel 33 and the central panel 31 together mechanically independent of the adhesive bonding of the right bead 35 to the right side panel 33 or the central panel 31. The right bead exterior surface 105 spans between the exterior surface 93 of the central panel 31 on the first side of the right joint seam 82 and the exterior surface 92 of the right side panel 33 on the second side of the right joint seam 82 and hides the elongate right joint seam 82 along its length from visual view outwardly of the cover.

Figure 17:
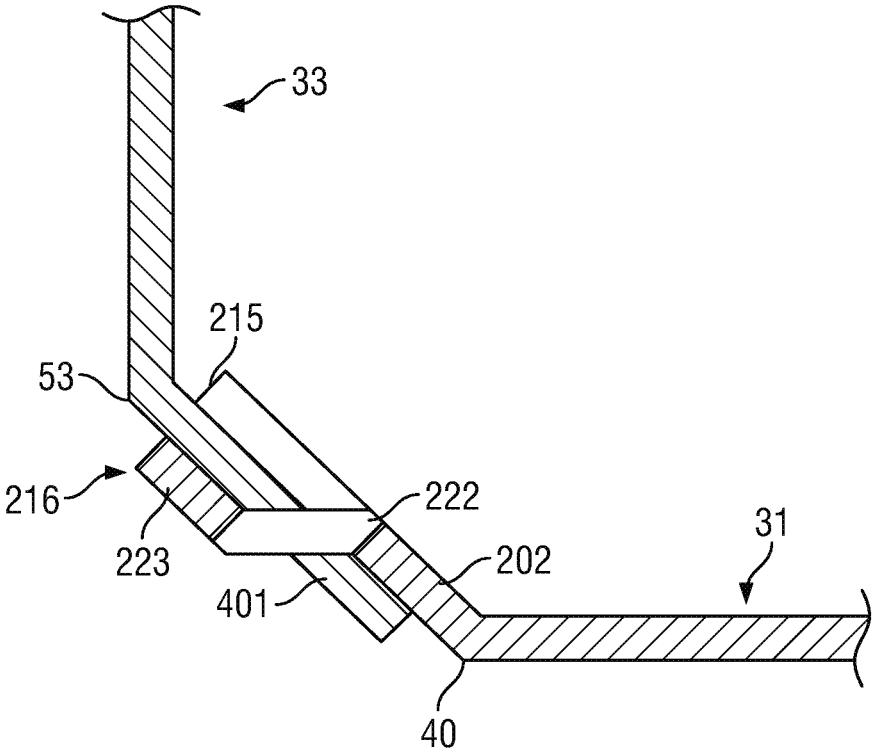
FIG. 17 is a view similar to FIG. 14, however, along section line A-A' in FIG. 13.

Reference is made to FIG. 17 which illustrates a cross-sectional view similar to FIG. 15, however, along a notional section A-A' in FIG. 13 through a modified tab 216 in the form of a hook tab. The hook tab 216 extends from the tab bight 217 as a tab base portion 222 of a reduced longitudinal extent with the tab base portion 212 widening proximate the tab distal end 215 as a tab arm portion 223. The hook tab 216 in assembly slides through its respective slot 416 so that it extends laterally therethrough in a manner similar to that shown in FIG. 15, however, after assuming the orientation analogous to that shown in FIG. 15, the tab arm portion 223 is mechanically bent upwardly such that the tab arm portion 223 underlies the flange 401 of the right side panel 33 mechanically securing the flange 202 of the central panel 31 to the flange 401 of the right side panel 33.

Figure 18:
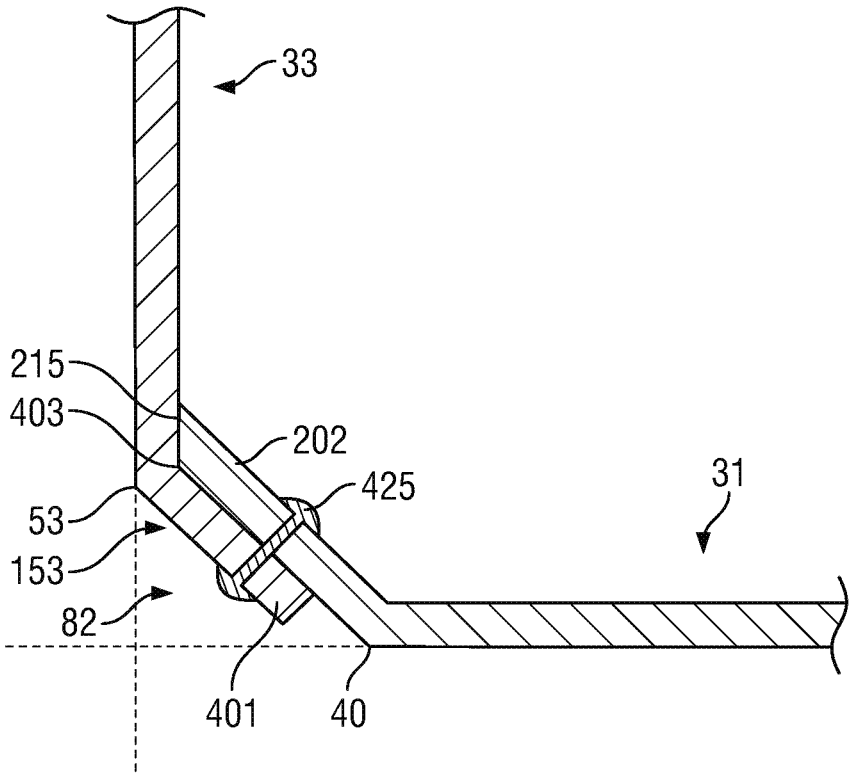
FIG. 18 is a view similar to FIG. 15 but showing a third embodiment of the present invention adapted to form an overlapping joint seam in accordance with the present invention.

Reference is made to FIG. 18 which shows a third embodiment of the present invention adapted to form a simple overlapping joint seam. In the embodiment of FIG. 18, the right side panel 33 is the same as the right side panel shown in FIG. 13, however, the slots 416 shown in FIG. 13 are not provided. In the embodiment of FIG. 18, the central panel 31 is identical to the central panel 31 shown in FIG. 13, however, with the tabs 216 shown in the embodiment of FIG. 13 not provided. Thus, as seen in FIG. 18, the right edge portion 153 of the right side panel 33 provides a flange 401 which overlies with the flange 202 of the right edge portion 150 of the central panel 31. While not necessary, a rivet 425 is shown as mechanically coupling the flange 401 to the flange 202 with the rivet extending through an opening in the flange 401 and an aligned opening in the flange 202. In FIG. 18, the distal end 215 of the flange 202 is shown as to engage in a complementary manner with the bight 403 of the right edge portion 153 of the right side panel 33 as can be of assistance in relatively locating the right side panel 33 and the central panel 31 as, for example, in the case that the rivet is not provided.

In the embodiment of FIG. 18, after locating the right side panel 33 and the central panel 31 in a mechanically coupled orientation as shown in FIG. 18, a right side bead may be extruded as in the manner discussed with reference to FIG. 16.

Figure 21:
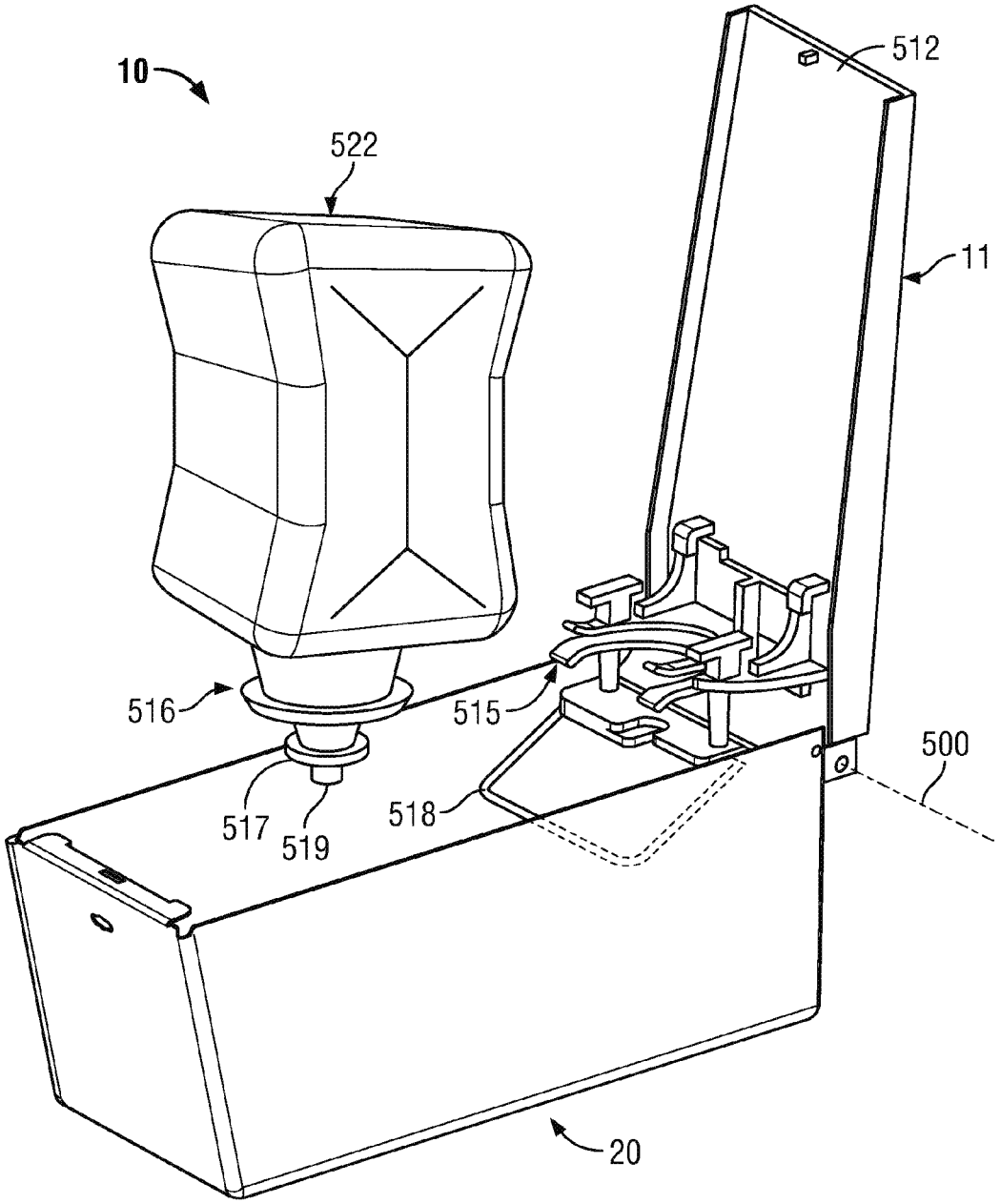
FIG. 21 is a pictorial view of a dispenser in accordance with the invention with a cover as shown in FIG. 1.

Reference is made to FIG. 21 which illustrates a dispenser 10 in accordance with the first embodiment of the present invention. As best seen in FIG. 21, the dispenser 10 includes a housing 11 to which the cover 20 in accordance with FIG. 1 is mounted with the cover 20 pivotable about a horizontal axis 500 for movement relative the housing 11 between an open position as shown in FIG. 21 and a closed position in which the cover 20 is pivoted upwardly to engage on the housing 11. The housing 11 includes a vertical backplate 512 from which a support shelf member 515 extends forwardly to support a bottle 522 containing fluid to be dispensed. The bottle 522 has an opening at its lower end within which a piston pump 516 is secured. The piston pump has a vertically slidable piston 517. A hand lever 518 is pivotally mounted for pivoting about a horizontal axis parallel the axis 500. Manual pivoting of the lever 518 moves the piston 517 upwardly and downwardly to discharge hand cleaning fluid from an outlet 519 on the piston 517 onto a person's hand (not shown) below the outlet 519. The fluid within the bottle 522 can be replenished when the cover 20 is in the open position, preferably by removing the bottle 522 and its attached pump 516.

When the cover 20 is in a closed position, a cavity is defined between the cover 20 and the housing 11 that contains the bottle 522 and the fluid to be dispensed. Movement of the cover 20 to the open position as shown in FIG. 21 provides access to the cavity for replenishment of the fluid.

Figure 20:
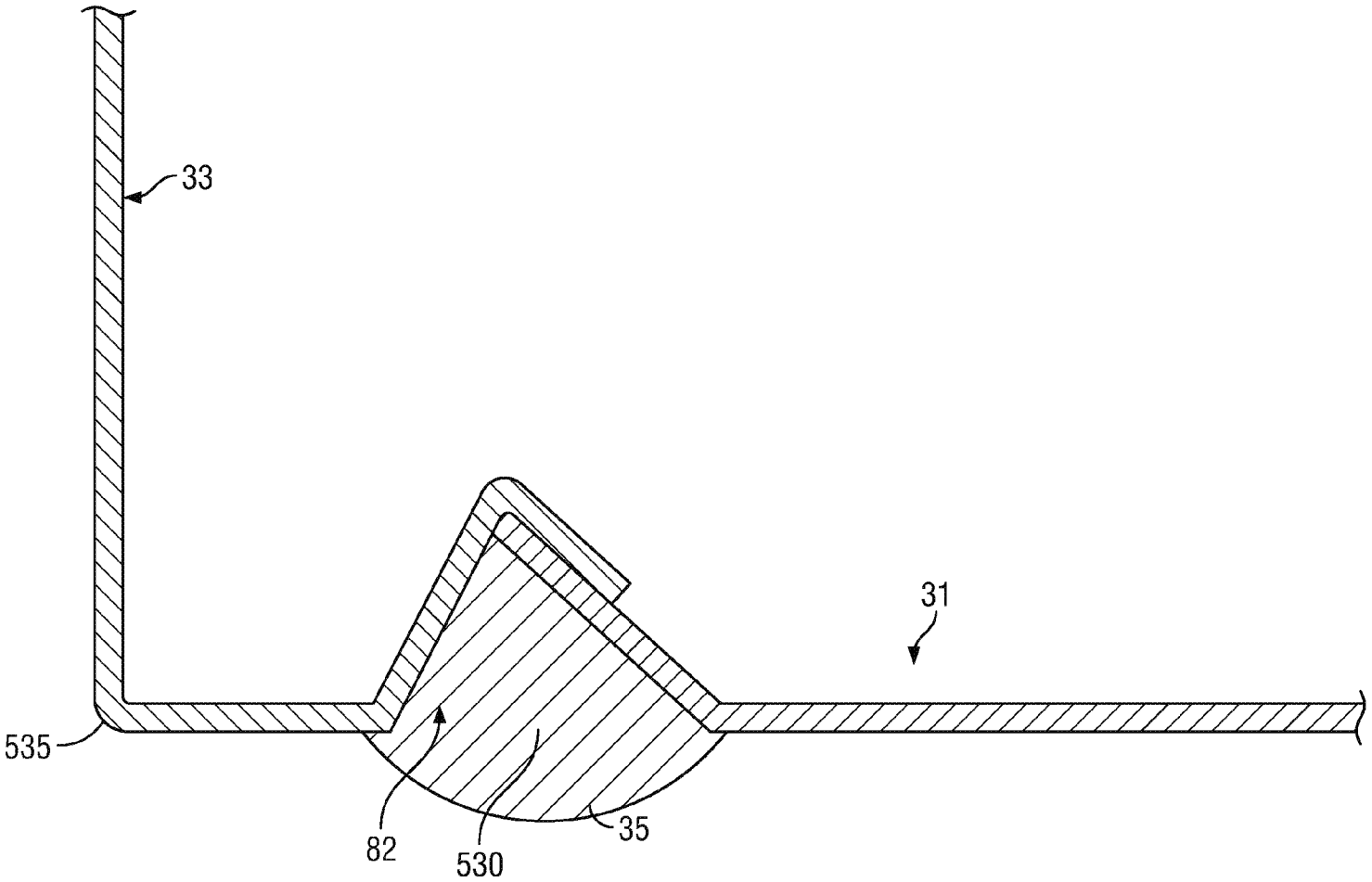
FIG. 20 is a view similar to FIG. 18 but showing a fifth embodiment of the present invention and adapted to form another overlapping joint seam in accordance with the present invention.

In FIG. 20, the cover 20 is pivotally mounted to the housing proximate the lower rear of the cover 20. This is not necessary. The cover 20 may be pivotally mounted, for example, at the bottom front of the housing 511 or may otherwise be mounted for relative sliding or removal from the housing 511 for movement between a closed position in which the dispenser is operative and an open position in which access is provided to the cavity. The preferred embodiment of FIG. 21 illustrates a dispenser for dispensing hand cleaning fluid onto the hands of a user. In the context of FIG. 20, inside the cavity, rather than provide a bottle 522 for dispensing a consumable fluid, a cartridge arrangement may be provided for dispensing of disposable towels as, for example, leaf paper or separable sheets of paper carried on a roll is adapted for use in drying of a person's hand after washing or to be provided near a toilet as sanitary paper. The particular nature of the consumable product which is to be dispensed by the dispenser is not limited.

The particular nature of the dispenser and the manner in which a cartridge containing consumables such as the bottle may be coupled to the dispenser is not limited and various arrangements for mounting of the cover to a housing including those as, for example, disclosed in U.S. Pat. No. 7,232,045 to Ophardt et al, issued Jun. 19, 2007, the disclosure of which is incorporated herein by reference and U.S. Pat. No. 5,431,309 to Ophardt, issued Jun. 11, 1995. Internally within the cover and the cavity, rather than provide a bottle to dispense liquid, rolls of paper may be provided as, for example, in a similar manner disclosed in U.S. Pat. No. 8,479,957 to Ophardt, issued Jul. 9, 2013, the disclosure of which is incorporated herein by reference.

Figure 19:
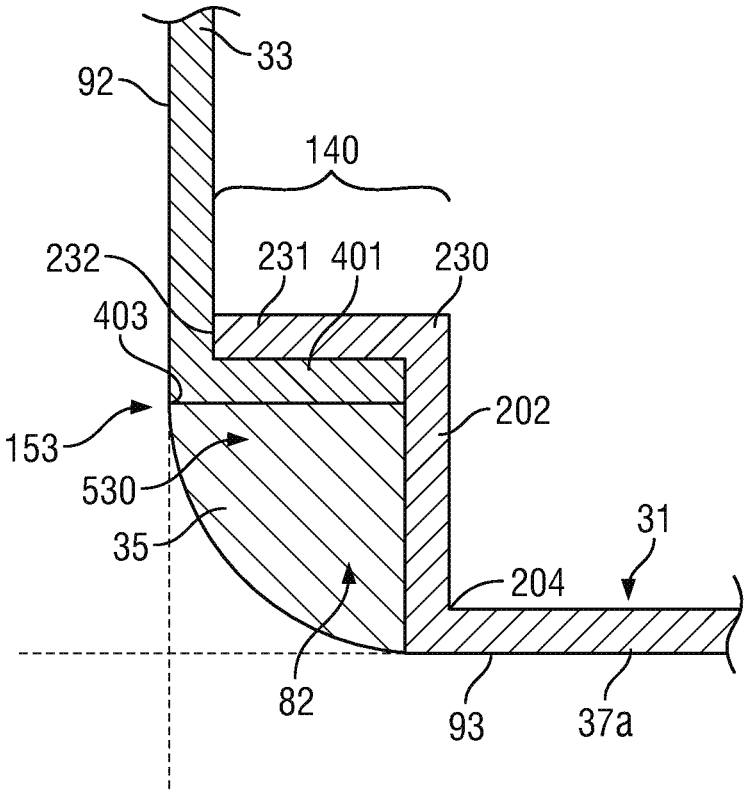
FIG. 19 is a view similar to FIG. 18 but showing a fourth embodiment of the present invention adapted to providing an overlapping joint seam in accordance with the present invention.

Reference is made to FIG. 19 which shows a fourth embodiment of the present invention adapted to form another simple overlapping joint seam, however, in which a channelway 530 is provided at the corner between the right side panel 33 and the central panel 31 into which the right side bead 35 may be extruded. As seen in FIG. 19, the right edge portion 153 of the right side panel 33 provides a flange 401 which is bent at 90 degrees about a bight 403. The right edge portion 140 of the central panel 31 has a flange 202 bent about a bight 204 to extend inwardly from the front panel 35 and preferably disposed at an angle of about 90 degrees relative to the forwardly directed front surface 37*a*. At a second bight 230, the right edge portion 140 is bent to extend laterally outwardly as a flange 231 which extends parallel to the forwardly directed surface 37*a* and to end at a distal end 232. As can be seen, the flange 401 and the flange 231 are disposed engaged upon each other to provide a right side seam 82 which extends longitudinally along an edge of the cover and which is adapted to be filled with the right bead 35 to adhesively bond the right side panel 33 to the central panel 31 preferably with the exterior surface of the right side bead 35 spanning between the exterior surface 92 of the right side panel 33 and the exterior surface 93 of the central panel 31 hiding the joint seam 82 from view.

Reference is made to FIG. 20 which illustrates a sixth embodiment of a seam in accordance with the present invention which has substantial similarities to the arrangement shown in FIG. 19, however, in which there is defined between the abutting right side panel 33 and the central panel 31 a joint seam 82 including channelway 530 spaced inwardly from a corner 535 of the cover and which is adapted to be filled by the right bead 35 hiding the channelway therein from view.

As seen in FIGS. 1 and 11, in the preferred first embodiment, the left bead 34 and the right bead 35 are each provided to have a cross-sectional (profile which provides a corner 90 between a flat surface 92 in the plane of the exterior flat surfaces 37 and 38 of the central panel 31 and a flat surface 93 in the plane of the side surfaces 53 and 54 of the respective side panels 32 and 33. This is but one preferred configuration for the surface of the beads 34 and 35 and is by no means limited. The beads 34 and 35 may be rounded or of other shapes and may include longitudinally extending grooves therein. The beads may be disposed above or below the surfaces of the adjacent portions of the central panel 31 or each of the side panels 32 and 33. Each of the beads 34 and 35 may be concave rounded outwardly or convex rounded inwardly as in the manner of a depression or groove.

Figure 22:
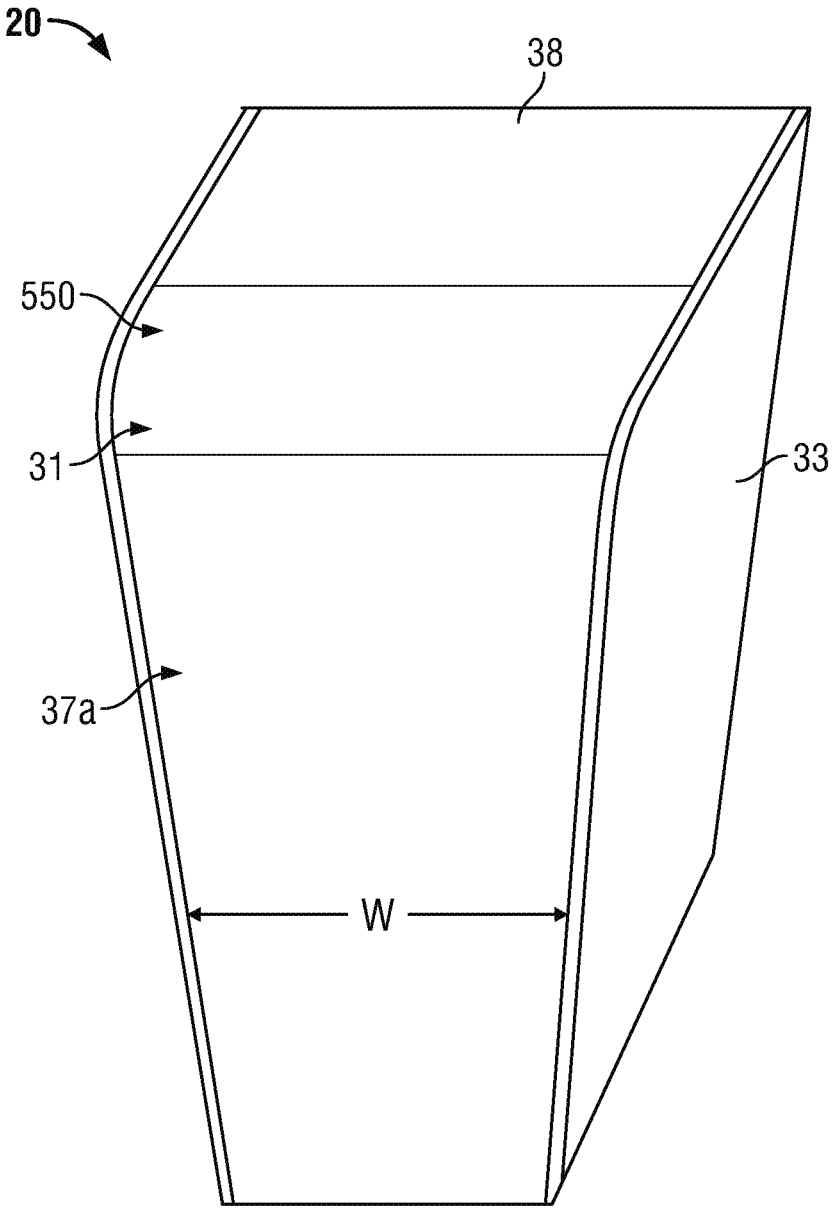
FIG. 22 is a schematic pictorial view of a cover in accordance with a further embodiment of the present invention.

In the embodiments illustrated in FIGS. 1 to 21, the cover 20 is generally rectilinear in shape and configuration with the beads following the rectilinear shape. This is not necessary and the forward surface 37 and top surface 38 of the central panel 31 need not be rectangular nor need the side surface 47 or the right side surface 52 be rectilinear. In accordance with the present invention, relative combinations of polygonal whether or not rectangular may be adopted for each of the front surface, top surface and the left and right side surfaces. In FIGS. 1 to 21, the central panel 31 is shown to have a flat top surface and a flat front surface 37*a* joined at a bend. This is not necessary and, as seen in the embodiment of FIG. 22, the front surface 37*a* of the central panel 31 may merge upwardly into the upwardly directed top surface 38 through a curved transition surface 550. In addition, the width W of the central panel 31 in FIG. 22 tapers downwardly towards its bottom edge.

In accordance with the present invention of the central panel 31, the left side panel 32 and the right side panel 33 are subjected to processes including cutting and bending from sheet material from which they are formed followed by assembly and then the extrusion of the beads. Advantageously, the sheet material may be painted or have information or graphics printed thereon before or after the folding process and before the bead is applied. The finishes and printing can be applied to the external surfaces of the panels advantageously either prior to cutting or folding or after cutting and folding but before the beads are applied. Providing the cover 20 to be formed from sheet material can permit relatively small numbers of customized covers to be produced having different size, configuration, appearance and permit relatively small numbers of customized covers to be produced having different size, configuration, appearance and colour notably as contrasted with arrangements in which covers may be injection moulded utilizing expensive moulds. In accordance with the present invention, computerized equipment may be pre-set up to handle different cutting and bending operations of the panels and machinery to automatically apply the beads can similarly be set up for applying the beads to different configurations permitting relatively simple switching from one embodiment for a cover to another embodiment.

The preferred cover as illustrated includes a front surface, a top surface, a left surface and a right surface. The invention is not limited. It is to be appreciated that similar covers could be developed which would include, in addition, one or more of a bottom surface and a back surface.

Figure 23:
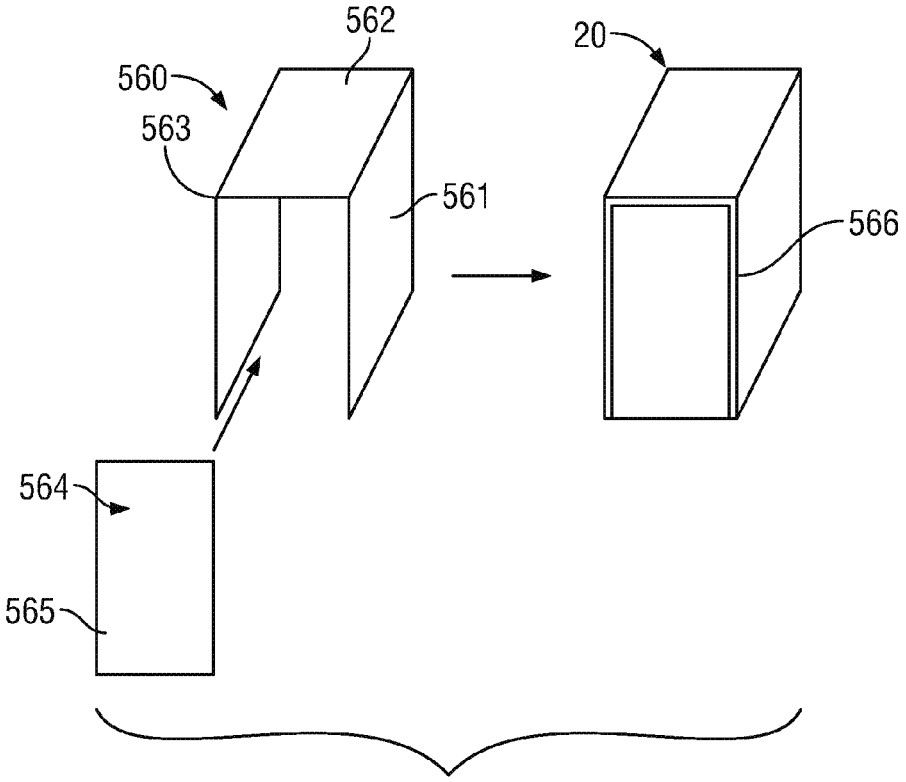
FIG. 23 is a schematic pictorial view illustrating a cover in accordance with another embodiment of the present invention.

In a cover as illustrated in FIG. 1, the central panel 31 provides both a front surface and a top surface and two separate left and right side panels 32 and 33 are provided. This is not necessary. FIG. 23 schematically illustrates an arrangement for a cover 20 in which a U-shaped first member 560 is provided to provide a right side surface 561, a top surface 562 and a left side surface 563 and in which a separate second front panel 564 provides a front surface 565. The members 560 and 564 are to be coupled together via a joint seam which extends in a U-shaped manner along the right edge, top edge and left edge of the second panel which joint seam is then to be covered by a suitable U-shaped bead 566 in an analogous manner to which the bead is provided over the seams in FIG. 1.

Figure 24:
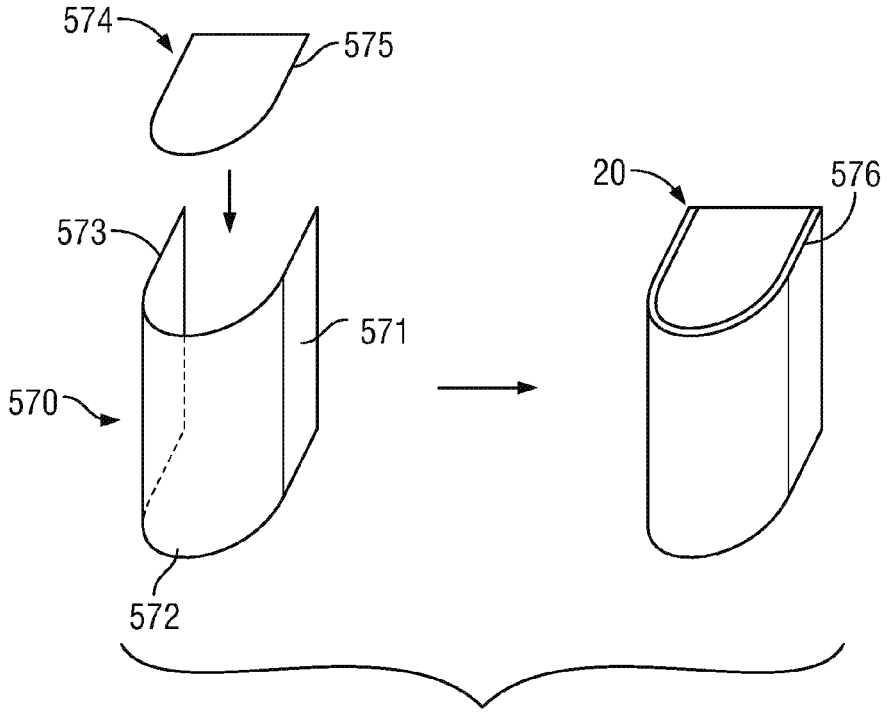
FIG. 24 is a schematic pictorial view illustrating a cover in accordance with another embodiment of the present invention.

FIG. 24 illustrates another arrangement in which a generally U-shaped first member 570 provides the right surface 571, front surface 572 and left surface 573 and a second member 574 provides the top surface 575. The members 570 and 574 are joined by a U-shaped seam about the top surface which seam is then to be covered by a U-shaped bead 576 of material as seen in the completed version shown in the top right hand side of FIG. 23. The covers 20 shown in each of FIGS. 22 and 23 in the top right hand side of the FIGS. 22 and 23 provide the extruded beads 566 and 576 to hide the joint seam joining the members together and providing a pleasing decorative appearance to the resultant cover.

While the invention has been described with reference to preferred embodiments, many variations and modifications may now occur to a person skilled in the art. For a definition of the invention, reference is made to the following claims.

I claim:

1. A cover defining a cavity therein:

the cover including a central panel and a side panel, the central panel having an exterior surface, an edge and an edge portion bordering along the edge of the central panel, the side panel having an exterior surface, an edge and an edge portion bordering along the edge of the side panel, the central panel mechanically coupled to the side panel by a mechanical coupling of the edge portion of the central panel to the edge portion of the side panel forming an elongate joint seam therebetween along which the exterior surface of the central panel is discontinuous with the exterior surface of the side panel, an elongate bead of hardened extruded material extending longitudinally of the joint seam and overly the joint seam, the bead having a surface extending circumferentially thereabout normal a longitudinal of the bead, the surface consisting of a hidden-from-view interior surface and an outwardly directed visible exterior surface with the interior surface and the exterior surface merging circumferentially into each other, the bead interior surface bonded to both the edge portion of the central panel and the edge portion of the side panel to secure the edge portion of the central panel to the edge portion of the side panel, the bead interior surface spanning the joint seam, the bead interior surface adhesively bonded to the edge portion of the central panel proximate the joint seam on a first side of the joint seam and adhesively bonded to the edge portion of the side panel proximate the joint seam on a second side of the joint seam, the bead exterior surface spanning between the exterior surface of central panel on the first side of the joint seam and the exterior surface of the side panel on the second side of the joint seam and hiding the elongate joint seam along its length from visual view outwardly from the cover.

2. A cover as claimed in claim 1 wherein:

the central panel comprises a forwardly directed front panel and an upwardly directed top panel as an L-shaped unitary first sheet member merging continuously from the front panel into the top panel, the side panel is a second separate unitary sheet member, the edge of the central panel extends along a side of the front panel and a side of the top panel, and the edge portion comprises an edge portion of the front panel and an edge portion of the top panel, the edge of the side panel comprises a front edge and a top edge and the edge portion of the side panel comprises a front edge portion bordering along the front edge of the side panel and a top edge portion bordering along the top edge of the side panel, along the joint seam the mechanical coupling joining the edge portion of the front panel to the front edge portion of the side panel and the top edge portion of the top panel to the top edge portion of the side panel to define the joint seam both between the front panel and the side panel and between the top panel and the side panel, the bead extending along the length of the joint seam merging continuously from overlying the joint seam between the front panel and the side panel to between the top panel and the side panel.

3. A cover as claimed in claim 1 wherein:

the edge portion of the central panel includes a locating member which engages with a complementary located member on the edge portion of the side panel to mechanically couple the central panel to the side panel, the locating member becoming engaging with a respective located member by relative movement of the central panel relative the side panel to mechanically secure the central panel to the side panel.

4. A cover as claimed in claim 3 wherein:

the bead surface having a constant cross-sectional profile along the joint seam.

5. A cover as claimed in claim 4 wherein the central panel comprises a unitary first sheet member, and the side panel a unitary second sheet member.

6. A cover as claimed in claim 5 wherein the unitary first sheet member comprises a first sheet of metal and the unitary second sheet member comprises a second sheet of metal.

7. A cover as claimed in claim 6 wherein the joint seam comprises a grooved seam joint with the edge portion of the central panel comprising a first open hem and the edge portion of the side panel comprising a second open hem complementary to the first open hem.

8. A cover as claimed in claim 7 wherein the bead forms a corner between the exterior surface of the central panel and the exterior surface of the side panel.

9. A cover as claimed in claim 6 wherein the joint seam comprises a slot and tab seam joint with a plurality of tab members carried on a first edge portion selected from the edge portion of the central panel and the edge portion of the side panel and slots to receive the tabs carried on a second element different than the first element selected from the edge portion of the central panel and the edge portion of the side panel.

10. A cover as claimed in claim 9 wherein the bead forms a corner between the exterior surface of the central panel and the exterior surface of the side panel.

11. A dispenser of a consumable product selected from the group of hand cleaning fluid and hand towels, the dispenser comprising:

a housing and a cover mounted to the housing for movement between an open and a closed position, a cavity defined between the housing and the cover when the cover is in the closed position containing the consumable product, the dispenser activatable to dispense the consumable product with the cover in the closed position, when the cover is in the open position, access is provided to the cavity to replenish the consumable product, the cover including a central panel, a left side panel and a right side panel, wherein:

the central panel having an exterior surface, a left edge and a left edge portion bordering along the loft edge of the central panel, the left side panel having an exterior surface, an edge and an edge portion bordering along the edge of the left side panel, the central panel mechanically coupled to the left side panel along a left by a mechanical coupling of the left edge portion of the central panel to the edge portion of the left side panel forming an elongate left joint seam therebetween along which the exterior surface of the central panel is discontinuous with the exterior surface of the left side panel, an elongate left bead of hardened extruded material extending longitudinally of the left joint seam and overly the left joint seam, the left bead having a surface extending circumferentially thereabout normal a longitudinal of the left bead, the surface consisting of a hidden-from-view interior surface and an outwardly directed visible exterior surface with the interior surface and the exterior surface merging circumferentially into each other, the left bead interior surface bonded to both the left edge portion of the central panel and the edge portion of the left side panel to secure the left edge portion of the central panel to the edge portion of the left side panel, the left bead interior surface spanning the left joint seam, the left bead interior surface adhesively bonded to the left edge portion of the central panel proximate the left joint seam on a first side of the left joint seam and adhesively bonded to the edge portion of the left side panel proximate the left joint seam on a second side of the left joint seam, the left bead exterior surface spanning between the exterior surface of central panel on the first side of the left joint seam and the exterior surface of the left side panel on the second side of the left joint seam and hiding the elongate left joint seam along its length from visual view outwardly from the cover, the central panel having an exterior surface, a right edge and a right edge portion bordering along the right edge of the central panel, the right side panel having an exterior surface, an edge and an edge portion bordering along the edge of the right side panel, the central panel mechanically coupled to the right side panel along a right by at mechanical coupling of the right edge portion of the central panel to the edge portion of the right side panel forming an elongate right joint seam therebetween along which the exterior surface of the central panel is discontinuous with the exterior surface of the right side panel, an elongate right bead of hardened extruded material extending longitudinally of the right joint seam and overly the right joint seam, the right bead having a surface extending circumferentially thereabout normal a longitudinal of the right bead, the surface consisting of a hidden-from-view interior surface and an outwardly directed visible exterior surface with the interior surface and the exterior surface merging circumferentially into each other, the right bead interior surface bonded to both the right edge portion of the central panel and the edge portion of the right side panel to secure the right edge portion of the central panel to the edge portion of the right side panel, the right bead interior surface spanning the right joint seam, the right bead interior surface adhesively bonded to the right edge portion of the central panel proximate the right joint seam on a first side of the right joint seam and adhesively bonded to the edge portion of the right side panel proximate the right joint seam on a second side of the right joint seam, the right bead exterior surface spanning between the exterior surface of central panel on the first side of the right joint seam and the exterior surface of the right side panel on the second side of the right joint seam and hiding the elongate right joint seam along its length from visual view outwardly from the cover.

12. A dispenser as claimed in claim 11 wherein:

the central panel comprises a forwardly directed front panel and an upwardly directed top panel as an L-shaped unitary first sheet member merging continuously from the front panel into the top panel, the left side panel is a second separate unitary sheet member, and the right side panel is a third separate unitary sheet member, the left edge of the central panel extends along a left side of the front panel and a left side of the top panel, and the left edge portion comprises a left edge portion of the front panel and a left edge portion of the top panel, the edge of the left side panel comprises a front edge and a top edge and the edge portion of the left side panel comprises a front edge portion bordering along the front edge of the left side panel and a top edge portion bordering along the top edge of the left side panel, along the left joint seam the mechanical coupling joining the left edge portion of the front panel to the front edge portion of the left side panel and the left edge portion of the top panel to the top edge portion of the left side panel to define the left joint seam both between the front panel and the left side panel and between the top panel and the left side panel, the left bead extending along the length of the left joint seam merging continuously from overlying the left joint seam between the front panel and the left side panel to between the top panel and the left side panel, the right edge of the central panel extends along a right side of the front panel and a right side of the top panel, and the right edge portion comprises a right edge portion of the front panel and a right edge portion of the top panel, the edge of the right side panel comprises a front edge and a top edge and the edge portion of the right side panel comprises a front edge portion bordering along the front edge of the right side panel and a top edge portion bordering along the top edge of the right side panel, along the right joint seam the mechanical coupling joining the right edge portion of the front panel to the front edge portion of the right side panel and the right edge portion of the top panel to the top edge portion of the right side panel to define the right joint seam both between the front panel and the right side panel and between the top panel and the right side panel, the right bead extending along the length of the right joint seam merging continuously from overlying the right joint seam between the front panel and the right side panel to between the top panel and the right side panel.

13. A dispenser as claimed in claim 12 wherein;

the left side panel having a laterally outwardly directed left side surface, the left side panel having a left side panel front edge, a left side panel rear edge, a left side panel bottom edge and a left side panel top edge, the left side panel front edge extending between the left side panel bottom edge and the left side panel to edge on a front of the left side panel, the left side panel rear edge site extending between the left side panel bottom edge and the left side panel top edge on a rear of the left side panel, the right side panel having a laterally outwardly directed right side surface, the right side panel having a right side panel front edge, a right side panel rear edge, a right side panel bottom edge and a right side panel top edge, the right side panel front edge extending between the right side panel bottom edge and the right side panel top edge on a front of the right side panel, the right side panel rear edge extending between the right side panel bottom edge and the right side panel top edge on a rear of the right side panel, the left side panel and the central panel coupled together with (a) the left side panel front edge extending along the left edge portion of the front panel with a lower portion of the left joint therebetween, and (b) the left side panel top edge extending along the left edge portion of the top panel with a top portion of the left joint seam therebetween;

the right side panel and the central panel coupled together with (a) the right side panel front edge extending along the right edge portion of the front panel with a lower portion of the right joint therebetween, and (b) the right side panel top edge extending along the right edge portion of the top panel with a top portion of the right joint seam therebetween.

14. A dispenser, as claimed in claim 11 the wherein:

the left edge portion of the central panel includes a left locating member which engages with a complementary left located member on the edge portion the left side panel to mechanically couple the central panel to the left side panel, the left locating member becoming engaging with a respective left located member by relative movement of the central panel relative the left side panel to mechanically secure the central panel to the left side panel, the right edge portion of the central panel includes a right locating member which engages with a complementary right located member on the edge portion of the right side panel to mechanically couple the central panel to the right side panel, the right, locating member becoming engaging with a respective right, located member by relative movement of the central panel relative the right side panel to mechanically secure the central panel to the right side panel.

15. A dispenser as claimed in claim 11 wherein the cover is symmetrical about a central plane between the left side panel and the right side panel, each of the left side panel and the right side panel is a mirror image of the other about the central plane, and each of the left bead and the right bead is a mirror image of the other about the central plane.

16. A dispenser as claimed in claim 11 wherein the central panel comprises a unitary first sheet of metal, the left side panel comprises a unitary second sheet of metal, and the right side panel comprises a unitary third sheet of metal, the left bead forms a corner between the exterior surface of the central panel and the exterior surface of the left side panel, the right joint seam forms a corner between the exterior surface of the central panel and the exterior surface of the right side panel, and the left seam is selected from the group comprising:

a. a grooved seam joint with the left edge portion of the central panel comprising a first open hem and the edge portion of the left side panel comprising a second open hem complementary to the first open hem, and b. a slot and tab seam joint with a plurality of tab members carried on a first edge portion selected from the left edge portion of the central panel and the edge portion of the left side panel and slots to receive the tab members carried on a second edge portion different than the first edge portion and selected from the left edge portion of the central panel and the edge portion of the left side panel.

17. A dispenser as claimed in claim 11 wherein the cover including a top panel and a front panel, the cover selected from the group in which:

a. the central panel comprises the front panel and the top panel as an L-shaped unitary first sheet member with a fold line between the front panel and the top panel, the left side panel is a second separate unitary sheet member, and the right side panel is a third separate unitary sheet member;

b. the central panel comprises the front panel as a unitary first sheet member, and the top panel, the left side panel and the right side panel is a second U-shaped separate unitary sheet member with a first fold line between the top panel and the left side panel and a second fold line between the top panel and the right side panel, and c. the central panel comprises the top panel as a unitary first sheet member, and the front panel, the left side panel and the right side panel is a second U-shaped separate unitary sheet member with a first fold line between the front panel and the left side panel and a second told line between the front panel and the right side panel.

18. A dispenser of a consumable product selected from the group of hand cleaning fluid and hand towels, the dispenser comprising:

a housing and a cover mounted to the housing for movement between an open and a closed position, a cavity defined between the housing and the cover when the cover is in the closed containing the consumable product, the dispenser activatable to dispense the consumable product with the cover in the closed position, when the cover is in the open position, access is provided to the cavity to replenish the consumable product, the cover including a central panel and a side panel, the central panel having an exterior surface, an edge and an edge portion bordering along the edge of the central panel, the side panel having an exterior surface, an edge and an edge portion bordering along the edge of the side panel, the central panel mechanically coupled to the side panel by a mechanical coupling of the edge portion of the central panel to the edge portion of the side panel forming an elongate joint seam therebetween along which the exterior surface of the central panel is discontinuous with the exterior surface of the side panel, an elongate bead of hardened extruded material extending longitudinally of the joint seam and overly the joint seam, the bead having a surface extending circumferentially thereabout normal a longitudinal of the bead, the surface consisting of a hidden-from-view interior surface and an outwardly directed visible exterior surface with the interior surface and the exterior surface merging circumferentially into each other, the bead interior surface bonded to both the edge portion of the central panel and the edge portion of the side panel to secure the edge portion of the central panel to the edge portion of the side panel, the bead interior surface spanning the joint seam, the bead interior surface adhesively bonded to the edge portion of the central panel proximate the joint seam on a first side of the joint seam and adhesively bonded to the edge portion of the side panel proximate the joint seam on a second side of the joint seam, the bead exterior surface spanning between the exterior surface of central panel on the first side of the joint seam and the exterior surface of the side panel on the second side of the joint seam and hiding the elongate joint seam along its length from visual view outwardly from the cover, the side portion of the central panel includes a locating member which engages with a complementary located member on the edge portion of the side panel to mechanically couple the central panel to the side panel, the locating member becoming engaged with a respective located member by relative movement of the central and relative the side panel to mechanically secure the central panel to the side panel.

19. A cover as claimed in claim 18 wherein the joint seam comprises a grooved seam joint with the edge portion of the central panel comprising a first open hem and the edge portion of the side panel comprising a second open hem complementary to the first open hem.

20. A dispenser as claimed in claim 18 wherein the left joint seam comprises a slot and tab seam joint with a first of the edge portion of the central panel and the edge portion of the side panel carrying a plurality of tab members and a second of the edge portion of the central panel and the edge portion of the side panel carrying slots to receive the tabs.

21. A method of making a cover for a dispenser of a consumable product selected from the group of hand cleaning fluid and hand towels, the cover including a central panel and a side panel, the central panel having an exterior surface, an edge and an edge portion bordering along the edge of the central panel, the side panel having an exterior surface, an edge and an edge portion bordering along the edge of the side panel, the central panel mechanically coupled to the side panel by a mechanical coupling of the edge portion of the central panel to the edge portion of the side panel forming an elongate joint seam therebetween along which the exterior surface of the central panel is discontinuous with the exterior surface of the side panel, an elongate bead of hardened extruded material extending longitudinally of the joint seam and overly the joint seam, the bead having a surface extending circumferentially thereabout normal a longitudinal of the bead, the surface consisting of a hidden-from-view interior surface and an outwardly directed visible exterior surface with the interior surface and the exterior surface merging circumferentially into each other, the bead interior surface bonded to both the edge portion of the central panel and the edge portion of the side panel to secure the edge portion of the central panel to the edge portion of the side panel, the bead interior surface spanning the joint seam, the bead interior surface adhesively bonded to the edge portion of the central panel proximate the joint seam on a first side of the joint seam and adhesively bonded to the edge portion of the side panel proximate the joint seam on a second side of the joint seam, the bead exterior surface spanning between the exterior surface of central panel on the first side of the joint seam and the exterior surface of the side panel on the second side of the joint seam and hiding the elongate joint seam along its length from visual view outwardly from the cover;

the method comprising the steps of:

a. mechanically coupling the side panel and the central panel together with the mechanical coupling to provide the joint seam and, subsequently, b. extruding the extruded material in a flowable state along the joint seam and hardening the extruded material in place overlying the joint seam to form the bead.

* * * * *